US011946369B1

(12) United States Patent
Chok et al.

(10) Patent No.: US 11,946,369 B1
(45) Date of Patent: Apr. 2, 2024

(54) DETERMINATION OF LOCATION AND TYPE OF RESERVOIR FLUIDS BASED ON DOWNHOLE PRESSURE GRADIENT IDENTIFICATION

(71) Applicant: Halliburton Energy Services, Inc., Houston, TX (US)

(72) Inventors: Hamed Chok, Houston, TX (US); Bin Dai, Katy, TX (US); Christopher Michael Jones, Katy, TX (US); Jonas Toelke, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/899,413

(22) Filed: Aug. 30, 2022

(51) Int. Cl.
*E21B 49/08* (2006.01)
*E21B 21/08* (2006.01)
*E21B 47/06* (2012.01)

(52) U.S. Cl.
CPC ..... *E21B 49/0875* (2020.05); *E21B 21/08* (2013.01); *E21B 47/06* (2013.01); *E21B 49/088* (2013.01)

(58) Field of Classification Search
CPC .... E21B 49/0875; E21B 49/088; E21B 47/06; E21B 47/00; E21B 47/10; E21B 49/00;
(Continued)

(56) References Cited

U.S. PATENT DOCUMENTS 5,337,821 A * 8/1994 Peterson ..... E21B 47/10 175/48
8,918,288 B2 12/2014 Chok et al.
(Continued)

FOREIGN PATENT DOCUMENTS

| | | |
|---|---|---|
| CN | 114427444 | 5/2022 |
| EP | 0913780 | 5/1999 |
| WO | 2016090138 A1 | 6/2016 |

OTHER PUBLICATIONS

Stark, et al., "Automated Artificial Intelligent Pressure Gradient Analysis for Fluid Contact and Compartmentalization Analysis", Society of Petroleum Engineers Middle East Oil and Gas Show and Conference, Manama, Bahrain, Mar. 15, 2019, SPE-195083-MS, Mar. 26, 2019 00:00:00.0, 12 pages.
(Continued)

*Primary Examiner* — Yong-Suk (Philip) Ro

(74) *Attorney, Agent, or Firm* — DeLizio, Peacock, Lewin & Guerra, LLP

(57) ABSTRACT

A method comprises receiving a measurement of a pressure in a subsurface formation at a number of depths in a wellbore formed in the subsurface formation across a sampling depth range of the subsurface formation to generate a number of pressure-depth measurement pairs and partitioning the sampling depth range into a number of fluid depth ranges. The method comprises performing a fitting operation over each of the number of fluid depth ranges to determine a fluid gradient for the type of the reservoir fluid for each of the number of fluid depth ranges. The method comprises generating a solution set of one or more solutions based on the fluid gradient of the reservoir fluid for each of the number of fluid depth ranges determined from performing the fitting operation, wherein each solution defines a partitioning of the sampling depth range and the fluid gradient of each fluid depth range.

20 Claims, 13 Drawing Sheets

(58) Field of Classification Search
CPC ..... E21B 21/08; E21B 44/00; G01V 1/50; G01V 1/52; G06F 17/30
See application file for complete search history.

(56) References Cited

U.S. PATENT DOCUMENTS

| | | | | |
|---|---|---|---|---|
| 9,581,015 | B2 | 2/2017 | Chok et al. | |
| 2013/0096835 | A1 | 4/2013 | Chok et al. | |
| 2015/0176393 | A1 | 6/2015 | Chok et al. | |
| 2015/0211363 | A1* | 7/2015 | Pop | E21B 49/0875 73/152.28 |
| 2016/0348480 | A1* | 12/2016 | Zuo | E21B 47/10 |
| 2018/0223612 | A1 | 8/2018 | Gleitman | |
| 2020/0003054 | A1* | 1/2020 | Yuratich | E21B 49/08 |
| 2020/0149387 | A1 | 5/2020 | Stark et al. | |
| 2021/0149070 | A1* | 5/2021 | Alfi | G01V 1/50 |
| 2021/0293122 | A1* | 9/2021 | Dumont | E21B 43/34 |
| 2023/0099449 | A1* | 3/2023 | Aljishi | G01V 99/005 702/6 |

OTHER PUBLICATIONS

"PCT Application No. PCT/US2022/075798, International Search Report and Written Opinion", dated May 23, 2023, 11 pages.

* cited by examiner

DETERMINATION OF LOCATION AND TYPE OF RESERVOIR FLUIDS BASED ON DOWNHOLE PRESSURE GRADIENT IDENTIFICATION

BACKGROUND

The disclosure generally relates to formation evaluation and, in particular, pressure monitoring at varying depths in a wellbore to determine if and the type of reservoir fluids that are present in the surrounding subsurface formation.

Determining the pressure at different depths in a wellbore can be used to maximize hydrocarbon recovery from the surrounding subsurface formation. In particular, the values of the pressure at different depths can be correlated to whether and the type of reservoir fluids that are present in the subsurface formation.

BRIEF DESCRIPTION OF THE DRAWINGS

Embodiments of the disclosure may be better understood by referencing the accompanying drawings.

DESCRIPTION OF EMBODIMENTS

Figure 1:
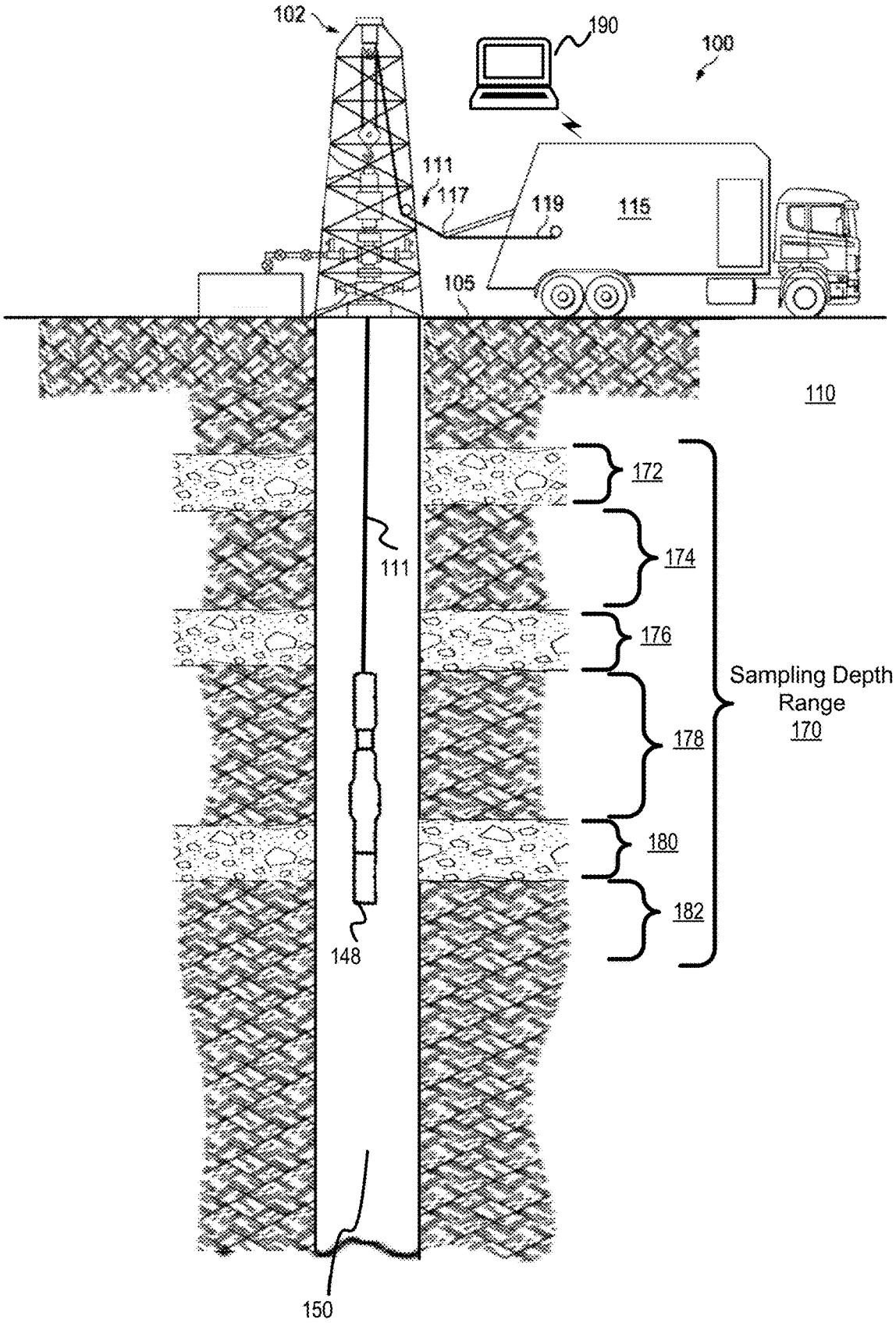
FIG. 1 depicts an example wireline system, according to some embodiments.

The description that follows includes example systems, methods, techniques, and program flows that embody embodiments of the disclosure. However, it is understood that this disclosure may be practiced without these specific details. For instance, this disclosure refers to determining the type of reservoir fluids based on a determined pressure gradient in a wellbore in illustrative examples. Embodiments of this disclosure can also be used to determine other types of formation attributes based on the determined pressure gradient. In other instances, well-known instruction instances, protocols, structures, and techniques have not been shown in detail in order not to obfuscate the description.

Example embodiments relate to identifying pressure gradients at different depths in a wellbore that can then be used to determine whether and the type of reservoir fluids present in the surrounding subsurface formation. Measurements of pressure at different depths of a wellbore can be indicative of the presence of reservoir fluids in the surrounding subsurface formation. Each reservoir fluid can manifest itself as a pressure gradient. A given subsurface formation may be comprised of any (a priori unknown) number of pressure gradients. In addition to not knowing the number of expected gradients, measurement errors can result in significant ambiguity in interpreting the fluid gradients. As further described below, example embodiments can be used to help resolve both of these problems.

Example embodiments can address multiple challenges with regard to pressure gradient determination across different depths of a wellbore. For example, a first challenge (being addressed by example embodiments) can include identifying the specific depth ranges for each fluid present in the surrounding subsurface formation. A second challenge being addressed can include determining a definitive fluid gradient over each of the identified depth ranges.

In some embodiments, a meta-heuristic process (e.g., simulated annealing) can be used to partition the complete depth range over individual fluid depth ranges. Additionally, a special-purpose fitting method can construct an estimate for the fluid gradients over these defined depth partitions. Such fitted fluid gradients can satisfy a number of domain (physical) constraints. Thus, in some embodiments, the combination of meta-heuristic depth-partition search and constrained multi-gradient fitting can yield a collection of solutions that potentially explain the observed (measured) data. In some implementations, this collection of solutions can be pruned to remove suboptimal solutions. In some embodiments, this collection of solutions can be used to assess the fluid gradient interpretation uncertainty. In turn, such an uncertainty can be used to devise a subsequent process wherein new depth values can be iteratively recommended for future sampling in an effort to reduce the interpretation uncertainty.

Thus, example embodiments can be robust against outlier solutions to access the fluid gradient interpretation uncertainty. Also, example embodiments can be readily scaled to the discontinuous pressure gradient setting wherein fluid gradients may not be in contact (i.e., separated by fluid barriers (non-fluid-bearing formation rock)). Example embodiments can also provide solutions that are less susceptible to local optimality as a result of the meta-heuristic optimization search. Additionally, as further described below, example embodiments can include an autonomous recommendation engine for additional sampling. Example embodiments can, thus, provide a greater interpretation autonomy that can assist in characterization of the reservoirs in the subsurface formation, while still optimizing pressure sample collection.

Conventional approaches for determining pressure gradients may use a clustering scheme to derive a pressure gradient solution collection. In contrast to example embodiments (described herein), such a clustering-driven fitting may not be robust against a heavy outlier presence. Additionally, example embodiments can include a set of inter-gradient and intra-gradient constraints that can be more comprehensive. Also, although the conventional approaches of clustering identify discrete subsets of points, such approaches do not infer fluid discontinuity. Furthermore, conventional approaches fail to resolve ambiguity. Instead, conventional approaches merely assume that more data may be needed and ensure that the algorithm may be updated incrementally until the ambiguity is (presumably) resolved.

Thus, example embodiments (unlike conventional approaches) do not require manual pre-removal of measurement outliers. Rather, outliers can be inherently and autonomously handled within the fitting operation. Also, conventional approaches (unlike example embodiments) are susceptible to local optimality. For instance, the conventional spline approach greedily seeks the one knot that achieves the optimum segment break and is recursively applied to the segment with the worst error. Greedy approaches generally cannot ensure non-local optimality. Similarly, the conventional local slope method relies on k-means clustering to finalize the gradients. As a result, this conventional method is also prone to local optimality. Additionally, these conventional approaches are not easily scalable to the discrete pressure gradient setting (i.e., presence of fluid barriers (node sections)). Finally, these conventional approaches do not scale well with the problem size as these approaches employ brute-force schemes.

Example System

FIG. 1 depicts an example wireline system, according to some embodiments. FIG. 1 depicts a wireline system 100 having a logging tool 148 operating inside a wellbore 150. While example operations are described in reference to the wireline system 100 of FIG. 1, example embodiments can be used in other downhole systems used in other stages of downhole operations. For example, some embodiments can be used in a drilling system. An example drilling system is depicted in FIG. 12 and further described below.

The wireline system 100 includes surface equipment above a ground surface 105 and the wellbore 150. The surface equipment is coupled to the logging tool 148 via a wireline 111. In general, surface equipment provides power, material, and structural support for the operation of the logging tool 148. In this example, the surface equipment includes a drilling rig 102 and associated equipment, and a data logging and control truck 115. The truck 115 can include a computer 190 and other devices to monitor data logging operations by the logging tool 148. In some embodiments, the computer 190 can be local or remote to the wellsite. A processor of the computer 190 may perform operations, such as downhole pressure gradient identification under uncertainty (as further described below). In some embodiments, the processor of the computer 190 can receive and store logging data from the logging tool 148 and/or control and direct logging operations. An example of the computer 190 is depicted in FIG. 13, which is further described below.

Below the drilling rig 102 is the wellbore 150 extending from the surface 105 into the earth 110 and passing through a plurality of subsurface formations. The wellbore 150 penetrates through the geologic formations and in some implementations forms a deviated path, which may include a substantially horizontal section. The wellbore 150 may be reinforced with one or more casing strings. The wireline 111 can be spooled out at the surface by the truck 115. A cable tension sensing device 117 is located at the surface and provides cable tension data to the truck 115. A speed sensor device 119 located at the surface provides surface cable speed data to the truck 115.

In some embodiments, the logging tool 148 can include sensors and other instruments to measure pressure at different depths of the wellbore 150. The logging tool 148 can transmit these different pressure-depth measurement pairs to the surface via the wireline 111 for further data processing (as further described below). As shown, a sampling depth range 170 can be defined in the wellbore 150. As further described below, the sampling depth range 170 can be a range of depth in the wellbore 150 over which a number of pressure-depth measurement pairs are sampled. Also, as shown, the sampling depth range 170 can be across multiple subsurface formations 172-182 that may be fluid bearing and non-fluid bearing. The pressure-depth measurement pairs sampled in the subsurface formations 172-182 of the sampling depth range 170 can be partitioned into a number of fluid depth ranges. Each of the fluid depth ranges can define a range where a type of reservoir fluid is present in the subsurface formations 172-182. Examples of such operations are now described.

Example Operations

Figure 2:
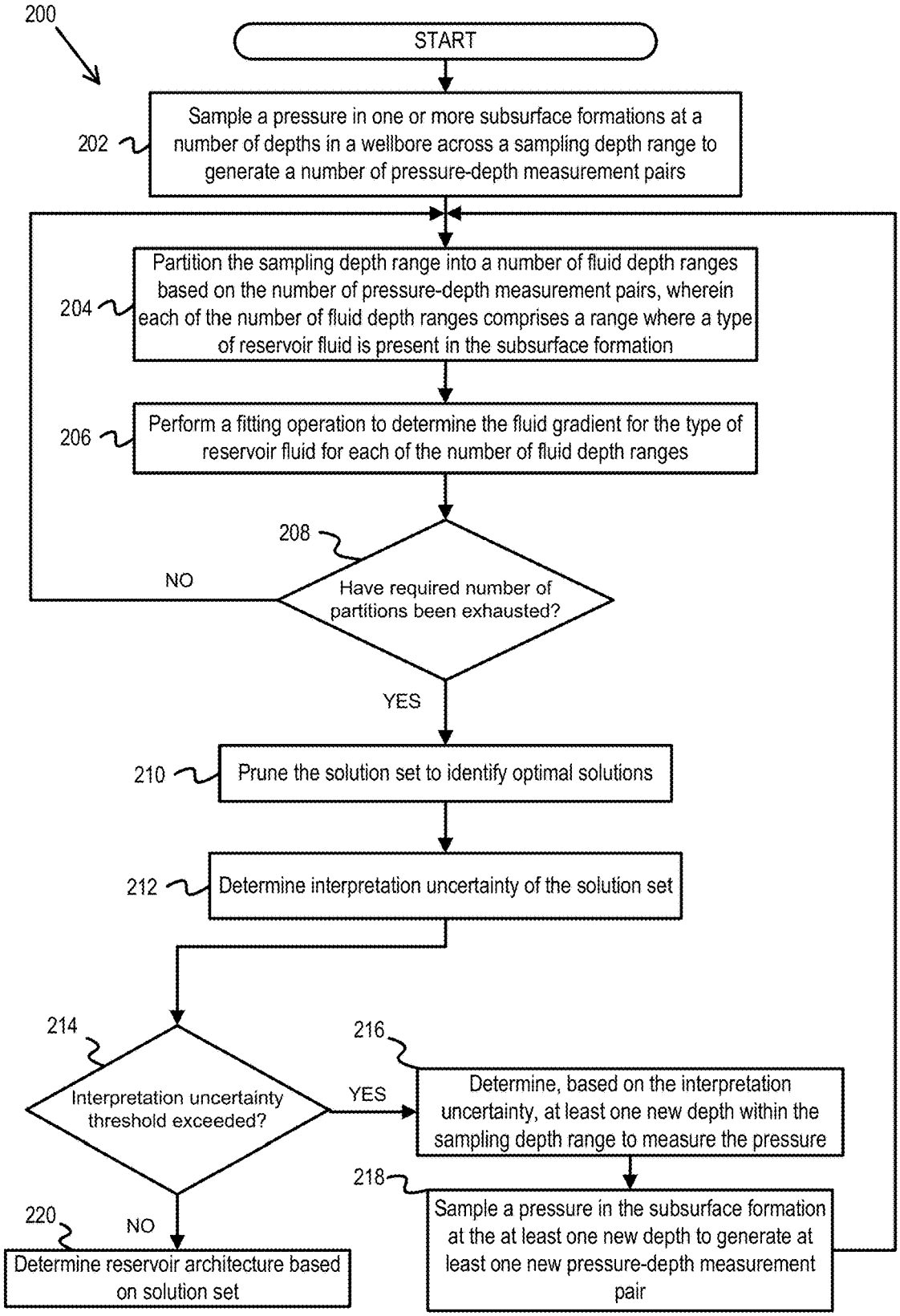
FIG. 2 depicts a flowchart of example operations to determine fluid depth ranges of reservoir fluids in one or more subsurface formations and corresponding fluid gradients based on pressure-depth pair measurements, according to some embodiments.

FIG. 2 depicts a flowchart of example operations to determine fluid depth ranges of reservoir fluids in one or more subsurface formations and corresponding fluid gradients based on pressure-depth pair measurements, according to some embodiments. The fluid depth ranges of each reservoir fluid in the subsurface formation(s) and corresponding fluid gradients of the reservoir fluids can further be exploited to determine the reservoir architecture of the subsurface formation and can be used to assess the fluid gradient interpretation uncertainty. In some instances, the reservoir architecture can comprise the reservoir architecture of a subsurface formation or portion of the subsurface formation that contacts the wellbore. FIG. 2 depicts a flowchart 200 of operations that can determine at least one partitioning of the pressure-depth measurement pairs comprising at least one fluid depth range, a linear fit (i.e., fluid gradient) of each fluid depth range (i.e., subset) in the underlying partitioning, and the reservoir architecture of the subsurface formation. Operations of flowchart 200 are described in reference to the logging tool 148 and processor of computer 190 of FIG. 1. Structure and organization of a program can vary due to platform, programmer/architect preferences, programming language, etc. In addition, names of code units (programs, modules, methods, functions, etc.) can vary for the same reasons and can be arbitrary. Operations of the flowchart 200 start at block 202.

At block 202, pressure is sampled in one or more subsurface formations at a number of depths in a wellbore across a sampling depth range to generate a number of pressure-depth measurement pairs. For example, with reference to FIG. 1, a wireline tool 148 and a processor of the computer 190 can perform these operations. In some embodiments, the complete depth range can be a depth interval across at least one subsurface formation, wherein the subsurface formation(s) may be fluid-bearing (i.e., contain gas, oil, and water) and non-fluid bearing (i.e., a barrier or seal). The sampling depth range may be selected to aid in determining reservoir architecture and further maximize hydrocarbon recovery from the subsurface formations. For instance, with reference to FIG. 1, the sampling depth range 170 is a range of depth across the subsurface formations 172-182. The subsurface formations 172, 176, and 180 may be fluid bearing and the subsurface formations 174, 178, and 182 may be non-fluid bearing.

In some embodiments, pressure can be sampled at a number of depths across the sampling depth range with a wireline tool in the wellbore (such as the wireline tool 148 of FIG. 1). The number of depths at which pressure is sampled can be based on a number of factors. Examples of such factors can include the length of the sampling depth range, the type of subsurface formations, etc. In some embodiments, the pressure can be sampled in intervals within the sampling depth range. For instance, pressure can be sampled every 5 feet, 30 feet, 100 feet, etc. of the sampling depth range. In some embodiments, the pressure can be sampled at depths within the sampling depth range based on a priori knowledge of the formation. For example, offset well logs and LWD measurements can be used to select depths within the sampling depth range where pressure can be sampled.

Figure 3:
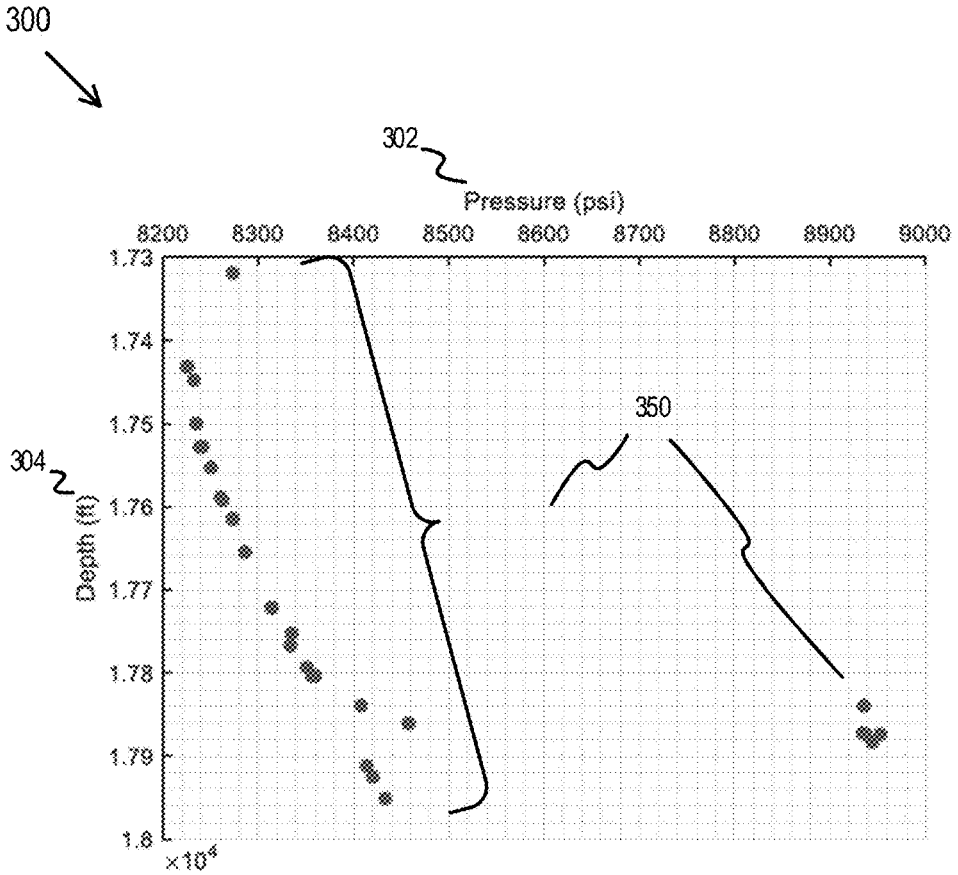
FIG. 3 depicts an example graph of pressure-depth measurement pairs, according to some embodiments.

The pressure samples and corresponding depths can be used to generate a number of pressure-depth measurement pairs. To help illustrate, FIG. 3 depicts an example graph of pressure-depth measurement pairs, according to some embodiments. FIG. 3 depicts a graph 300 that includes an x-axis 302 and a y-axis 304. The x-axis 302 is the pressure that is sampled in the subsurface formation and having units in pounds per square inch (psi). The y-axis 304 is the depth at which the sample was obtained and having in units of feet (ft). The graph 300 includes a number of sampling points 350 at different depths and having different sampled pressures.

At block 204, the sampling depth range is partitioned into a number of fluid depth ranges, wherein each of the number of fluid depth ranges comprises a range where a type of reservoir fluid is present in the subsurface formation. For example, with reference to FIG. 1, a processor of the computer 190 can do this partitioning. In some embodiments, a meta-heuristic process can be used to partition the sampling depth range into a number of fluid depth ranges. Examples of a meta-heuristic process can include a simulated annealing process, genetic algorithms, a particle swarm process, an ant colony process, a differential evolution process, etc. In some embodiments, partitioning the sampling depth range with a meta-heuristic process may yield at least one plausible depth partitioning configuration. To help illustrate, FIG. 4A-4K depict example graphs of possible partitions of the sampling depth range of FIG. 3 into fluid depth ranges, according to some embodiments. FIG. 4A-4K depict graphs 401, 403, 405, 407, 409, 411, 413, 415, 417, 419, and 421, respectively. The graphs 401-421 include an x-axis 480 and a y-axis 482. The x-axis 480 is the pressure that is sampled in the subsurface formation and having units in pounds per square inch (psi). The y-axis 482 is the depth that the sample was obtained and has units in feet (ft).

Figure 4A:
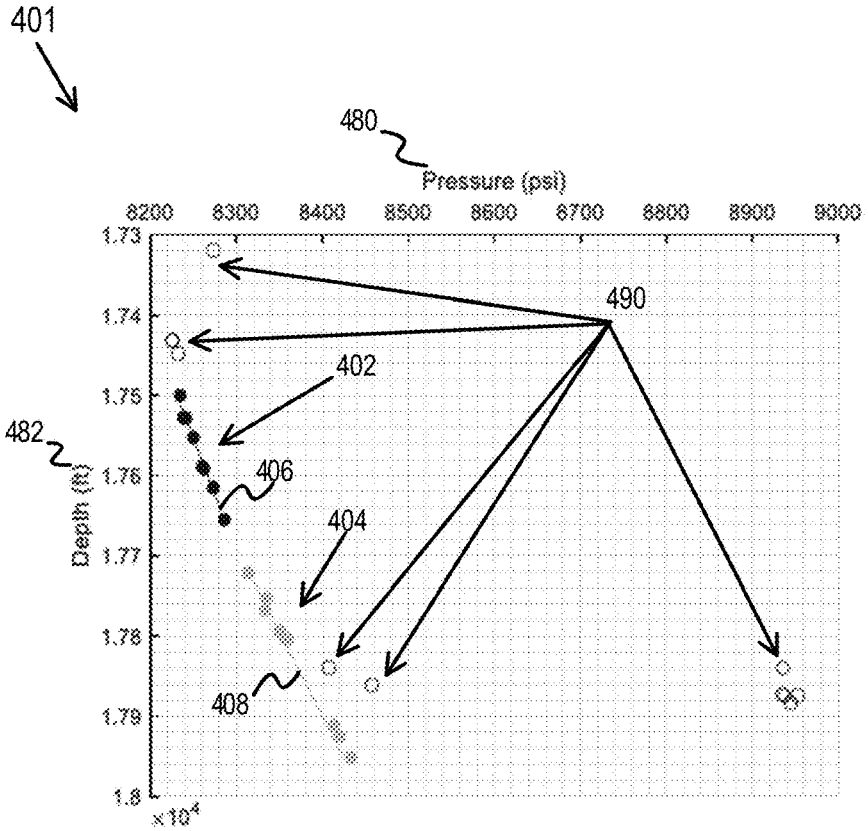
FIG. 4A-4K depict example graphs of possible partitions of the sampling depth range of FIG. 3 with at least one fluid depth range, according to some embodiments.

In FIG. 4A, the set of pressure-depth measurement pairs can be partitioned into a first fluid depth range 402 and a second fluid depth range 404, representing the depths at which a first reservoir fluid and a second reservoir fluid may be present within the subsurface location, respectively. The graph 401 also includes linear fits 406 and 408 that can be used to construct the fluid gradient for the reservoir fluid types in fluid depth ranges 402 and 404, respectively. The linear fits 406 and 408 are further described below in reference to the fitting operation at block 206 of the flowchart 200 of FIG. 2. FIGS. 4A-4K also include pressure-depth measurement points (termed outliers 490) that are identified as those points that cannot be included in a fluid depth range or within the associated linear fits. The outliers 490 can be those points whose locations on the graph are beyond a range or at such a position to not allow grouping of these outliers 490 with the other points that are within one of the fluid depth ranges.

Figure 4B:
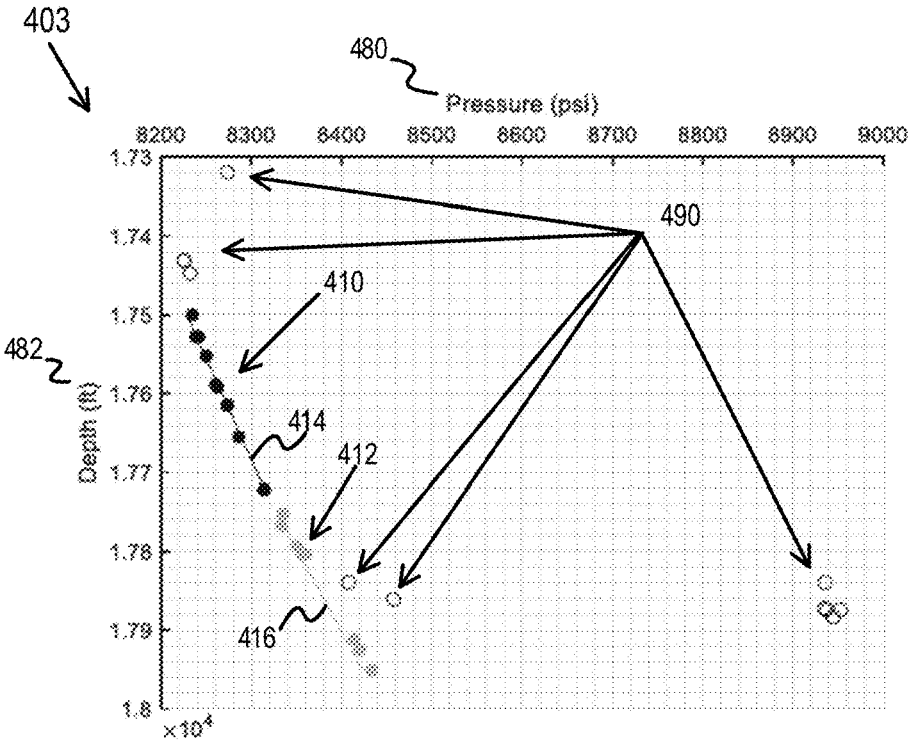

In FIG. 4B, the graph 403 depicts a different example partitioning of the sampling depth range of FIG. 3. The graph 403 includes a different partitioning of the set of pressure-depth measurement pairs—a first fluid depth range 410 and a second fluid depth range 412. The first fluid depth range 410 and the second fluid depth range 412 represent depths at which a first reservoir fluid and a second reservoir fluid are present within the subsurface location, respectively. In this example partitioning, the outliers 490 are similar to the outliers 490 identified in the graph 401 of FIG. 4A. The graph 403 also includes linear fits 414 and 416 that can be used to construct the fluid gradient for the reservoir fluid types in fluid depth ranges 410 and 412, respectively.

Figure 4C:
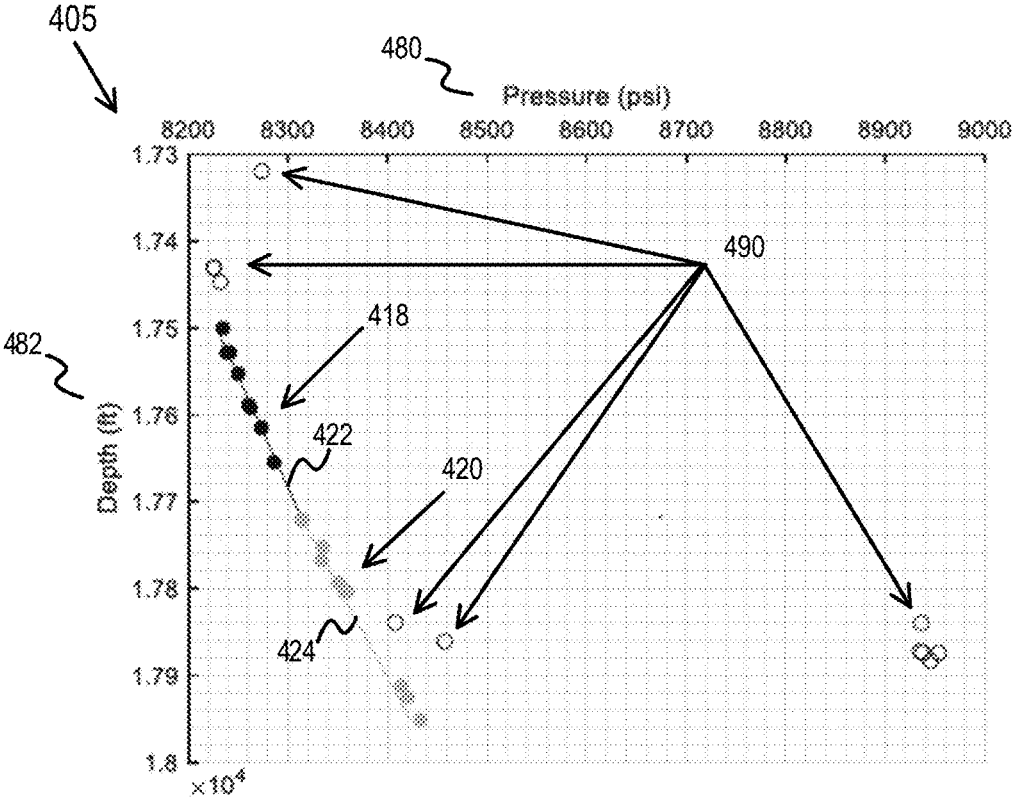

In FIG. 4C, the graph 405 depicts a different example partitioning of the sampling depth range of FIG. 3. The graph 405 includes a different partitioning of the set of pressure-depth measurement pairs—a first fluid depth range 418 and a second fluid depth range 420. The first fluid depth range 418 and the second fluid depth range 420 represent depths at which a first reservoir fluid and a second reservoir fluid are present within the subsurface location, respectively. In this example partitioning, the outliers 490 are similar to the outliers 490 identified in the graph 401 of FIG. 4A. The graph 405 also includes linear fits 422 and 424 that can be used to construct the fluid gradient for the reservoir fluid types in fluid depth ranges 418 and 420, respectively.

Figure 4D:
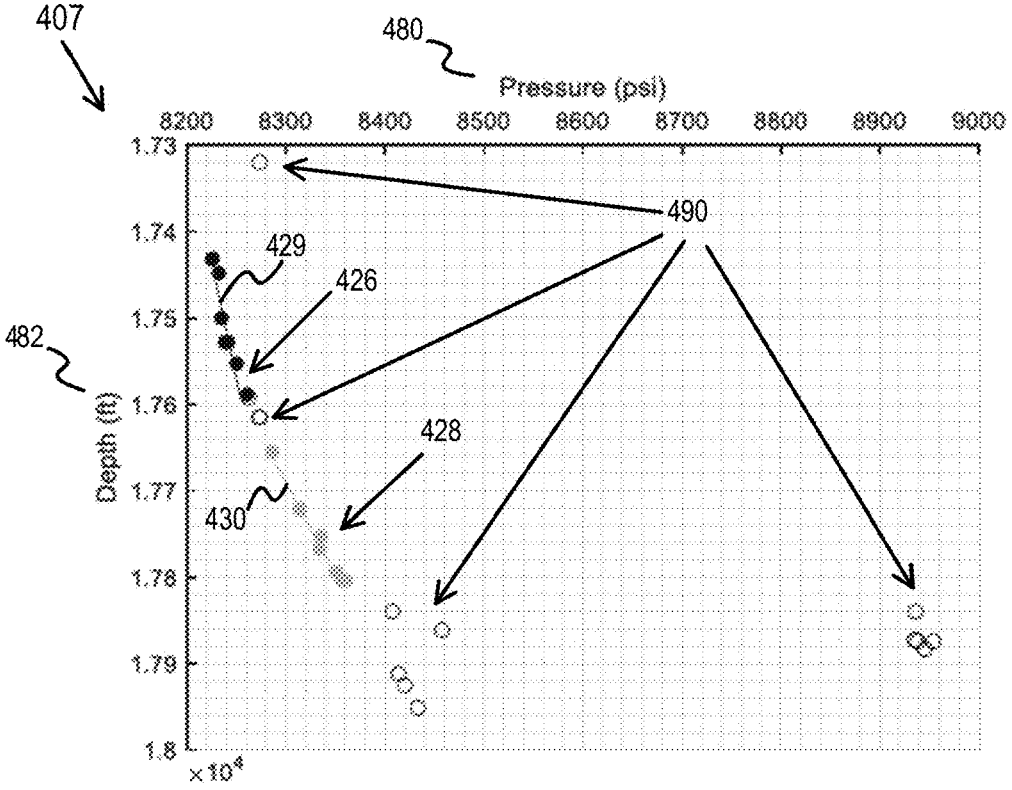

In FIG. 4D, the graph 407 depicts a different example partitioning of the sampling depth range of FIG. 3. The graph 407 includes a different partitioning of the set of pressure-depth measurement pairs—a first fluid depth range 426 and a second fluid depth range 428. The first fluid depth range 426 and the second fluid depth range 428 represent depths at which a first reservoir fluid and a second reservoir fluid are present within the subsurface location, respectively. In this example partitioning, the outliers 490 are similar to the outliers 490 identified in the graph 401 of FIG. 4A. The graph 407 also includes linear fits 429 and 430 that can be used to construct the fluid gradient for the reservoir fluid types in fluid depth ranges 426 and 428, respectively.

Figure 4E:
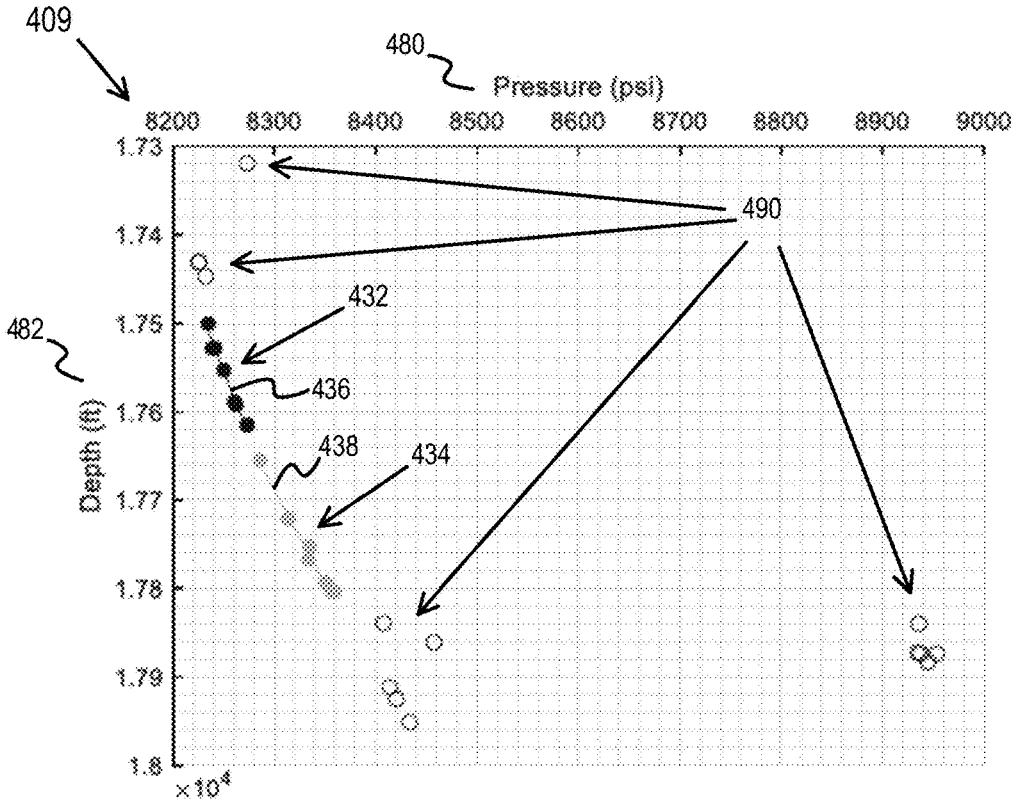

In FIG. 4E, the graph 409 depicts a different example partitioning of the sampling depth range of FIG. 3. The graph 409 includes a different partitioning of the set of pressure-depth measurement pairs—a first fluid depth range 432 and a second fluid depth range 434. The first fluid depth range 432 and the second fluid depth range 434 represent depths at which a first reservoir fluid and a second reservoir fluid are present within the subsurface location, respectively. In this example partitioning, the outliers 490 are similar to the outliers 490 identified in the graph 401 of FIG. 4A. The graph 409 also includes linear fits 436 and 438 that can be used to construct the fluid gradient for the reservoir fluid types in fluid depth ranges 432 and 434, respectively.

Figure 4F:
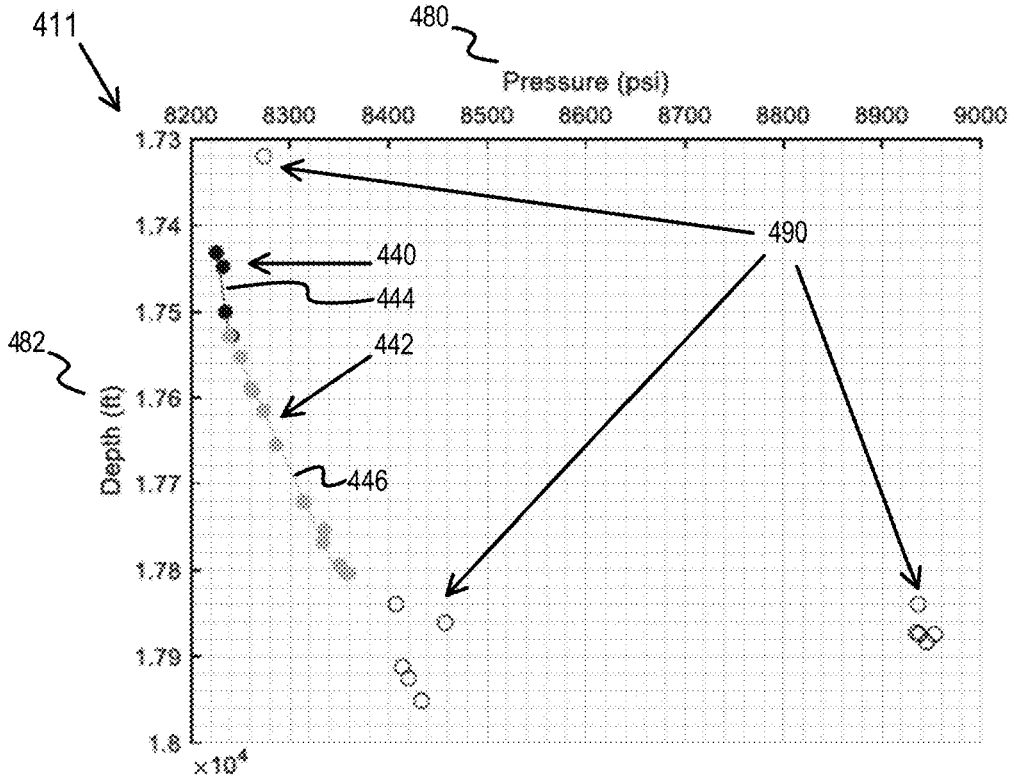

In FIG. 4F, the graph 411 depicts a different example partitioning of the sampling depth range of FIG. 3. The graph 411 includes a different partitioning of the set of pressure-depth measurement pairs—a first fluid depth range 440 and a second fluid depth range 442. The first fluid depth range 440 and the second fluid depth range 442 represent depths at which a first reservoir fluid and a second reservoir fluid are present within the subsurface location, respectively. In this example partitioning, the outliers 490 are similar the outliers 490 identified in the graph 401 of FIG. 4A. The graph 411 also includes linear fits 444 and 446 that can be used to construct the fluid gradient for the reservoir fluid types in fluid depth ranges 440 and 442, respectively.

Figure 4G:
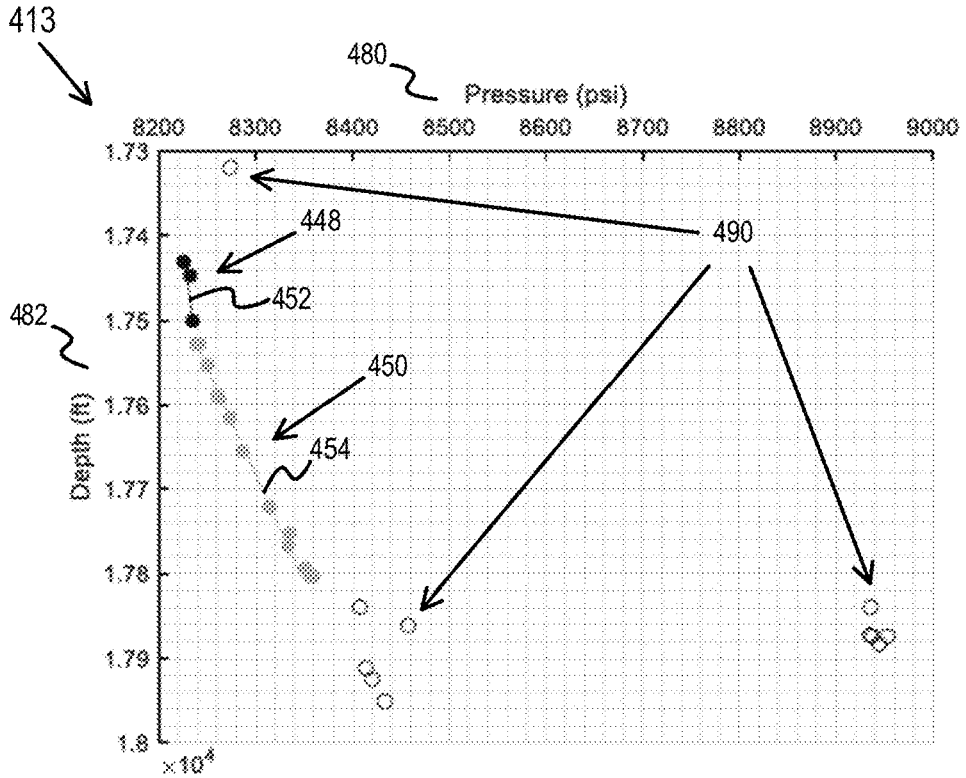

In FIG. 4G, the graph 413 depicts a different example partitioning of the sampling depth range of FIG. 3. The graph 413 includes a different partitioning of the set of pressure-depth measurement pairs—a first fluid depth range 448 and a second fluid depth range 450. The first fluid depth range 448 and the second fluid depth range 450 represent depths at which a first reservoir fluid and a second reservoir fluid are present within the subsurface location, respectively. In this example partitioning, the outliers 490 are similar the outliers 490 identified in the graph 401 of FIG. 4A. The graph 413 also includes linear fits 452 and 454 that can be used to construct the fluid gradient for the reservoir fluid types in fluid depth ranges 448 and 450, respectively.

Figure 4H:
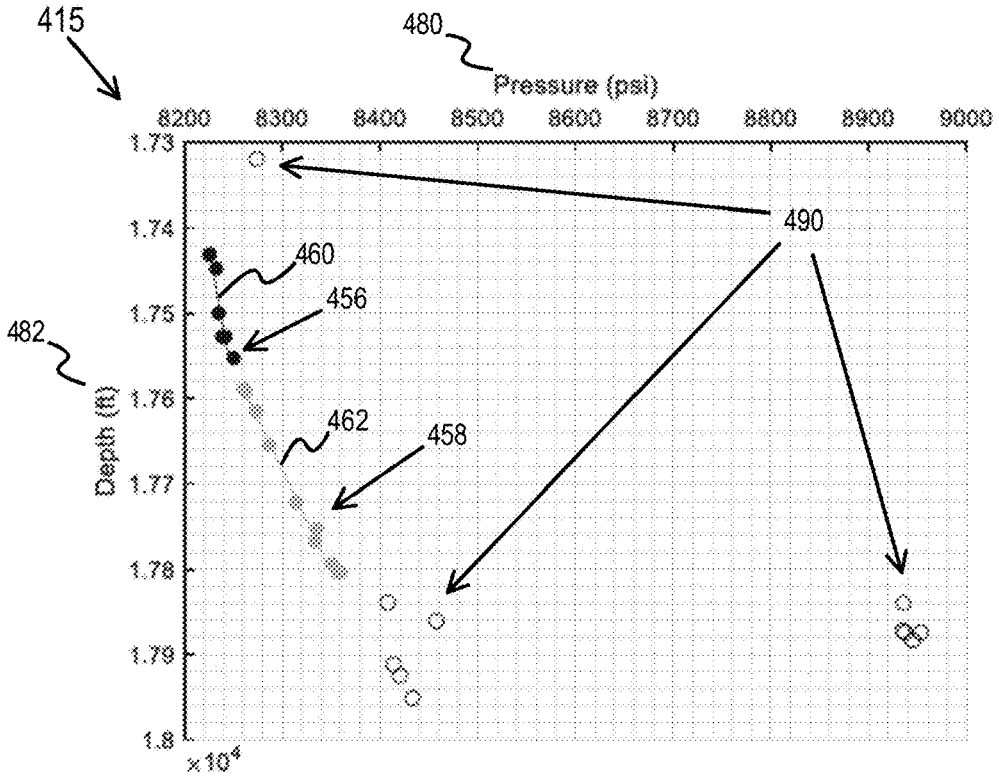

In FIG. 4H, the graph 415 depicts a different example partitioning of the sampling depth range of FIG. 3. The graph 415 includes a different partitioning of the set of pressure-depth measurement pairs—a first fluid depth range 456 and a second fluid depth range 458. The first fluid depth range 456 and the second fluid depth range 458 represent depths at which a first reservoir fluid and a second reservoir fluid are present within the subsurface location, respectively. In this example partitioning, the outliers 490 are similar the outliers 490 identified in the graph 401 of FIG. 4A. The graph 415 also includes linear fits 460 and 462 that can be used to construct the fluid gradient for the reservoir fluid types in fluid depth ranges 456 and 458, respectively.

Figure 4I:
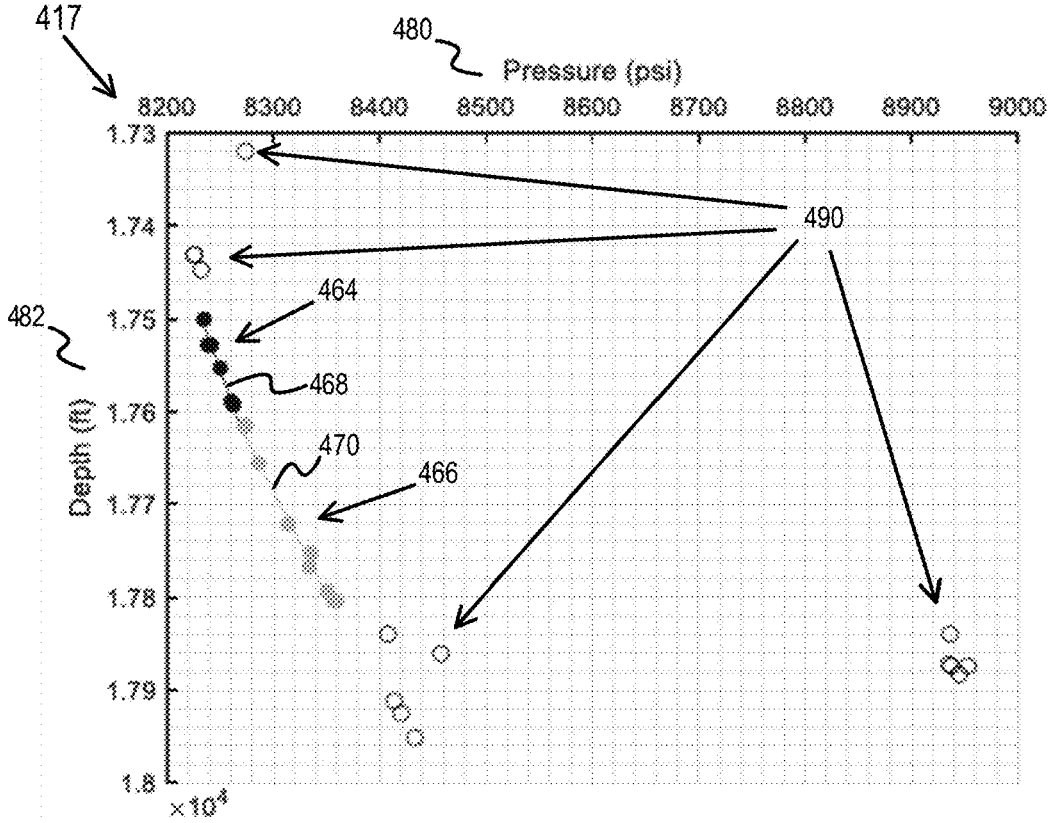

In FIG. 4I, the graph 417 depicts a different example partitioning of the sampling depth range of FIG. 3. The graph 417 includes a different partitioning of the set of pressure-depth measurement pairs—a first fluid depth range 464 and a second fluid depth range 466. The first fluid depth range 464 and the second fluid depth range 466 represent depths at which a first reservoir fluid and a second reservoir fluid are present within the subsurface location, respectively. In this example partitioning, the outliers 490 are similar the outliers 490 identified in the graph 401 of FIG. 4A. The graph 417 also includes linear fits 468 and 470 that can be used to construct the fluid gradient for the reservoir fluid types in fluid depth ranges 464 and 466, respectively.

Figure 4J:
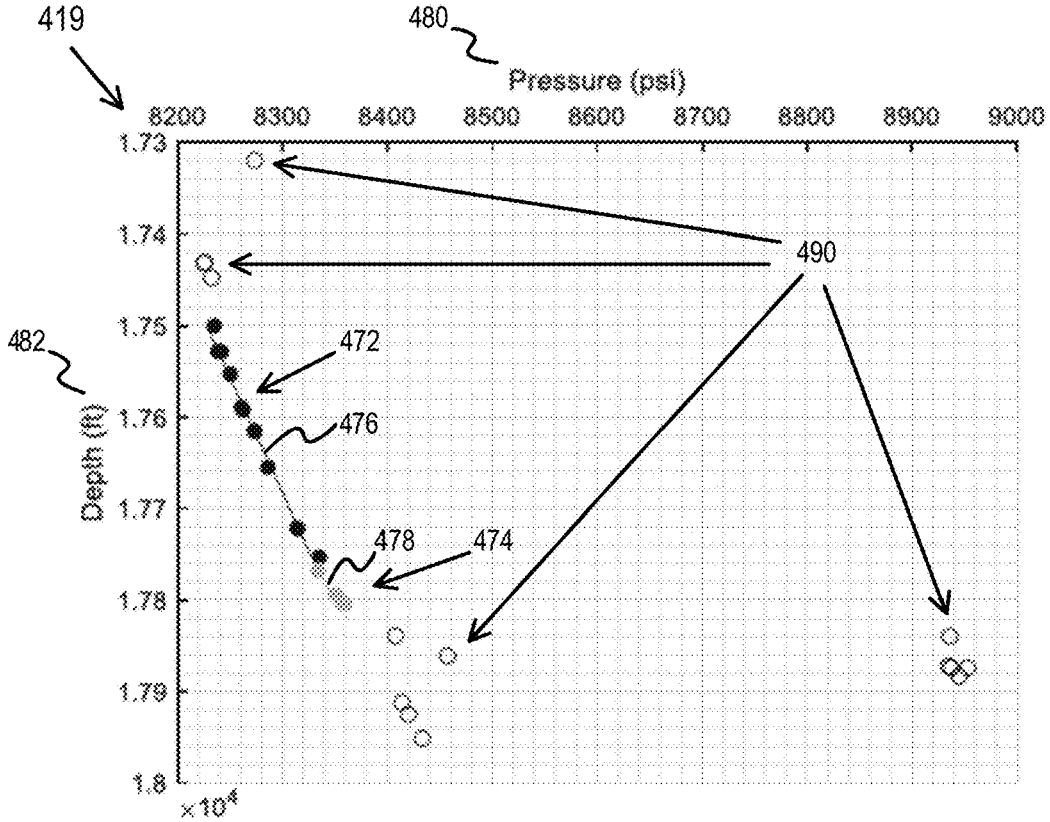

In FIG. 4J, the graph 419 depicts a different example partitioning of the sampling depth range of FIG. 3. The graph 419 includes a different partitioning of the set of pressure-depth measurement pairs—a first fluid depth range 472 and a second fluid depth range 474. The first fluid depth range 472 and the second fluid depth range 474 represent depths at which a first reservoir fluid and a second reservoir fluid are present within the subsurface location, respectively. In this example partitioning, the outliers 490 are similar the outliers 490 identified in the graph 401 of FIG. 4A. The graph 419 also includes linear fits 476 and 478 that can be used to construct the fluid gradient for the reservoir fluid types in fluid depth ranges 472 and 474, respectively.

Figure 4K:
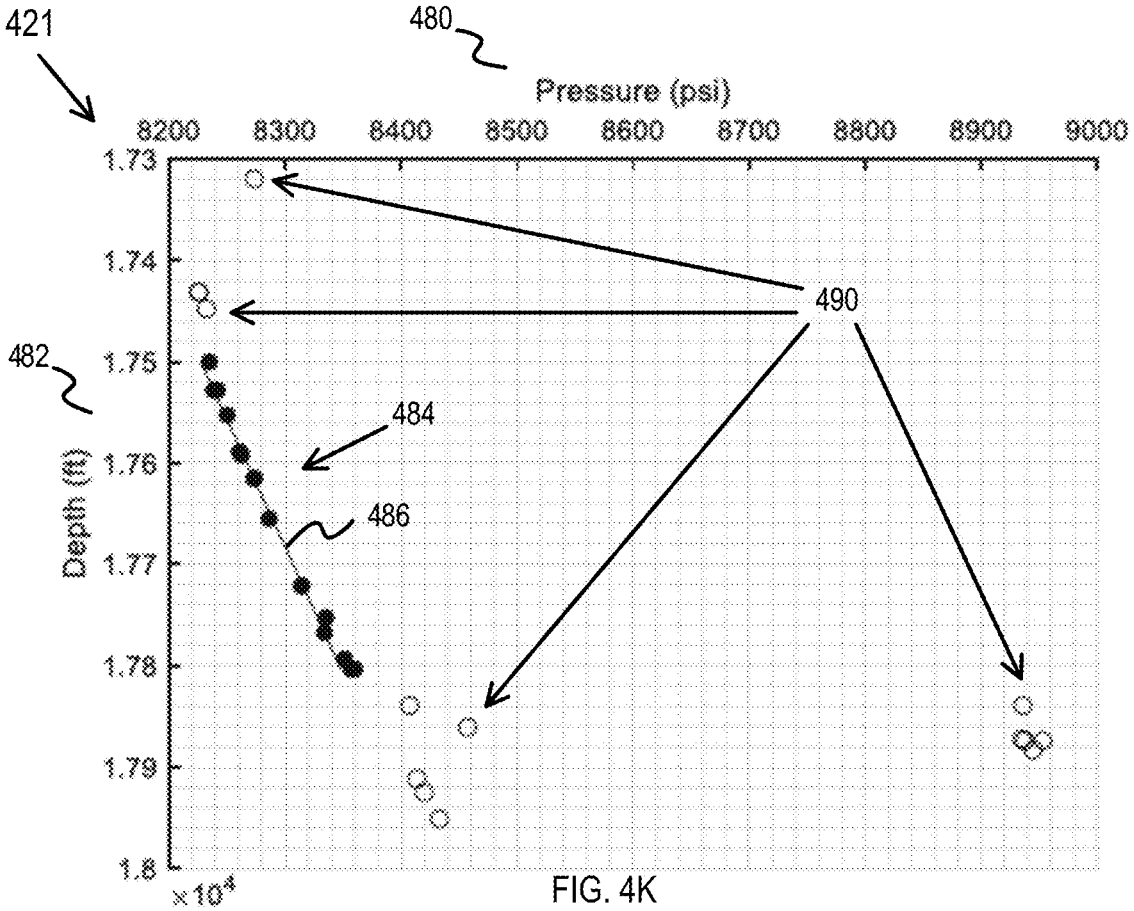

In FIG. 4K, the graph 421 depicts a different example partitioning of the sampling depth range of FIG. 3. The graph 421 includes a different partitioning of the set of pressure-depth measurement pairs—a fluid depth range 484. The fluid depth range 484 represents depths at which a reservoir fluid is present within the subsurface location. In this example partitioning, the outliers 490 are similar the outliers 490 identified in the graph 401 of FIG. 4A. The graph 421 also includes linear fit 486 that can be used to construct the fluid gradient for the reservoir fluid types in fluid depth range 484.

Returning to the operations of the flowchart 200 of FIG. 2, in some embodiments, simulated annealing may be used to partition the sampling depth range (to recover solutions to the problem of determining fluid gradients in a subsurface formation). To do so, the state space may first need to be defined for exploration by simulated annealing. The state of any solution may be fully specified via an ordered depth measurement sequence, where each consecutive pair of depth values in the sequence encloses a measurement point subset (i.e., equivalently a fluid depth range). Collectively, all inferred measurement point subsets (fluid depth ranges) define the underlying partitioning. In some implementations, the initial and last values in the ordered depth sequence may be trivial and may thus be excluded from the state space representation for more efficient processing. In some embodiments, simulated annealing may rely on components including, but not limited to an energy function, a temperature schedule, a neighbor function, and a state transition probability function to orchestrate the exploration of the state space. In some embodiments, simulated annealing will provide the guidance to optimize the energy function. Additionally, the temperature schedule, neighbor function, and state transition probability function can be the parameterization to the simulated annealing. Each component is further described below.

The energy function can represent the objective function that is being optimized. In some embodiments, the energy function can be a measure of the fitness of a given solution (i.e., a partition and the linear fit of the underlying partition). For example, the energy of each solution can be assessed in terms of the quality of the solution obtained from the constrained robust fit (e.g., the weighted norm of the residuals). In some embodiments, the quality of the solution will increase as the value output by energy function decreases. For instance, the optimal value of the energy function may arbitrarily approach zero to indicate gradients that fit with minimum error i.e., low measurement noise. An example constrained robust fit is further described below in reference to block 206. In some embodiments, the energy function, represented by $E_{w,P}$ (using Equations 1 and 2 below) can be defined as:

$$E_{w,P}(m, b) \triangleq \|\hat{y} - y\|w \triangleq (\hat{y} - y)W(\hat{y} - y)^T \tag{1}$$

$$\hat{y} \triangleq C(x, P) * \left(\frac{m}{b}\right) \tag{2}$$

Where x is a vector of measured depths, y is a vector of measured pressures, m is a vector of predicted gradient slopes, b is a vector of predicted gradient offsets, P is a given depth partitioning, W is a diagonal matrix defining residual weights, C(x, P) is a matrix used for pressure reconstruction, $\hat{y}$ is a vector of reconstructed pressures, and $E_{w,P}$(m,b) is the energy of a given solution specified via m, b, W, and P.

The simulated annealing process may be able to determine globally optimal solutions by performing guided random exploration of the solution space that may render it unsusceptible to local optimality. In some instances, a random state within the defined state space may be selected as the initial state. The simulated annealing process may then iteratively migrate from one state to a neighboring state. Next, the simulated annealing process may accept solutions with an energy that is worse (i.e., larger) than the energy of the current state. The extent of how much worse a solution's energy may be acceptable can be made variable in terms of the notion of a temperature schedule. A maximum number of annealing iterations may be defined. In some embodiments, the maximum number of iterations may be manually defined. For example, the maximum number of iterations can be 5, 100, 1000, etc. In some embodiments, a decaying temperature function, represented by T (c), $T_s$, and $T_f$ (using Equations 3, 4, and 5 below, respectively) over such an iteration range may be defined as follows:

$$T(c) \triangleq T_f + (T_s - T_f)^{exp\left(\frac{-ac}{maxiter}\right)} \tag{3}$$

$$T_s \triangleq \frac{-\Delta}{\log(P_s)} \tag{4}$$

$$T_f \triangleq \frac{-\Delta}{\log(P_f)} \tag{5}$$

Where maxiter is the maximum number of annealing iterations, c is the annealing iteration index, a is a constant, $\Delta$ is a constant representing the maximum expected energy differential over any neighborhood, $P_s$ is the initial probability of acceptance for worse solutions, $P_f$ is the final probability of acceptance for worse solutions, $T_s$ is the starting temperature, $T_f$ is the final temperature, T(c) is the temperature at iteration c. During the early portion of the temperature curve, the simulated annealing process may heavily encourage acceptance of severely worse (i.e., worse fit) solutions than the solution of the current state. In some embodiments, this may be known as the exploration stage of the simulated annealing process. Progressively, as the temperature drops off, exploration may be less encouraged, tying subsequent transitions to mostly solution exploitation.

In some embodiments, state transition is in part governed by a neighbor function. In some implementations, the neighbor function, represented by neighbor(p) (using Equation 6 below), can be defined as follows:

$$\text{neighbor}(p) \triangleq \text{sort}(p+r) \tag{6}$$

Where p is the ordered boundary vector representing depth partition and r is a random integer vector within a sufficiently small ball. Given a particular state (i.e., partitioning), the neighbor function may determine at random a new state deemed a neighboring state.

In some embodiments, given the current state and a suggested new state (i.e., the new state determined by the neighbor function), the transition probability function may assign a probability of acceptance of the new state based on the current temperature value and the energy differential between the two underlying states. The transition can then be taken according to the assigned probability. In some embodiments, if the energy of the new solution is greater than or equal to the energy of the current solution, then the transition probability function, represented by P (using Equation 7 below) can be defined as follows:

$$P(T_{curr}, E_{curr}, E_{new}) = \begin{cases} \exp\left(\dfrac{-(E_{new} - E_{curr})}{T_{curr}}\right) & \text{if } E_{new} \geq E_{curr} \\ 1 & \text{otherwise} \end{cases} \tag{7}$$

Where $E_{curr}$ is the energy of current solution, $E_{new}$ is the energy of new solution, $T_{curr}$ is the current temperature, and $P(T_{curr}, E_{curr}, E_{new})$ is the transition probability. In some embodiments, if the energy of the new solution is less than the energy of the current solution, than the transition probability can be 1 since finding an optimal solution requires minimizing the energy function.

At block 206, a fitting operation is performed to determine the fluid gradient for each of the number of fluid depth ranges identified in the underlying partition. For example, with reference to FIG. 1, a processor of the computer 190 can perform this operation. In some embodiments, a fitting operation can include a linear fit over each of the number of fluid depth ranges in the underlying partitioning to determine the potential fluid gradient for each reservoir fluid in the respective fluid depth ranges. For example, with reference to FIG. 4A, the fluid depth range 402 is fit with a linear fit 406 and the fluid depth range 404 is fit with a linear fit 408. The linear fits 406, 408 may be used to construct the fluid gradient for the reservoir fluid types in fluid depth ranges 402 and 404, respectively. In some embodiments, the requirement of the linear fit(s) may stem from physical principles governing the reservoir fluids and which may further impose predefined constraints on the linear fits.

For example, there may be a priori physical constraints that govern fluid gradients when viewed as a pressure function of depth. Example types of constraints include, but are not limited to, allowable slope ranges for each reservoir fluid type and inter-gradient constraints. To help illustrate, Table 1 below depicts example allowable slope ranges of fluid gradients.

TABLE 1

| Reservoir Fluid | Fluid Gradient ($g/cm^3$) | Fluid Gradient (kPA/m) | Fluid Gradient (psi/ft) |
|---|---|---|---|
| Gas | 0.1-0.2 | 1.0-2.0 | 0.04-0.09 |
| Sour Gas ($H_2S$) | 0.2-0.6 | 2.0-6.0 | 0.08-0.26 |
| Condensate | 0.2-0.55 | 2.0-5.5 | 0.8-0.24 |
| Oil | 0.68-0.85 | 6.8-8.5 | 0.29-0.37 |
| Water/Filtrate | 0.95-1.05 | 9.4-10.2 | 0.41-0.45 |
| Heavy Oil/Bitumen | 0.98-1.10 | 9.6-10.8 | 0.42-0.47 |
| Mud Fluids | 1.00-2.00 | 10.0-20.0 | 0.43-0.86 |

In some embodiments, reservoir fluids may be categorized into fluid types such as gas, oil, and water. For instance, with reference to FIG. 4A, if the linear fit 406 of the fluid depth range 402 is 0.15 $g/cm^3$, then the reservoir fluid of fluid depth range 402 can be categorized as a gas according to the example ranges of Table 1. Fluid gradient ranges depicted in Table 1 are example ranges. Some embodiments can define other example ranges. For example, the fluid gradient range of gas may be 0.06-0.15 psi/ft.

In some embodiments, there may be constraints that govern multiple fluid gradients simultaneously. For example, in a continuous gradient profile setting (i.e., the subsurface formation(s) in the sampling depth range are fluid bearing), a constraint can be that fluid gradients increase in depth. For instance, a reservoir fluid at a deeper depth must have a slope greater than that of a reservoir fluid at a shallower depth. As another example, for any two intersecting fluid gradients (i.e., in contact), a constraint can be that fitted reconstructions of pressure measurements belonging to each gradient should lie in the upper halfspace with respect to the other gradient.

Figure 5A:
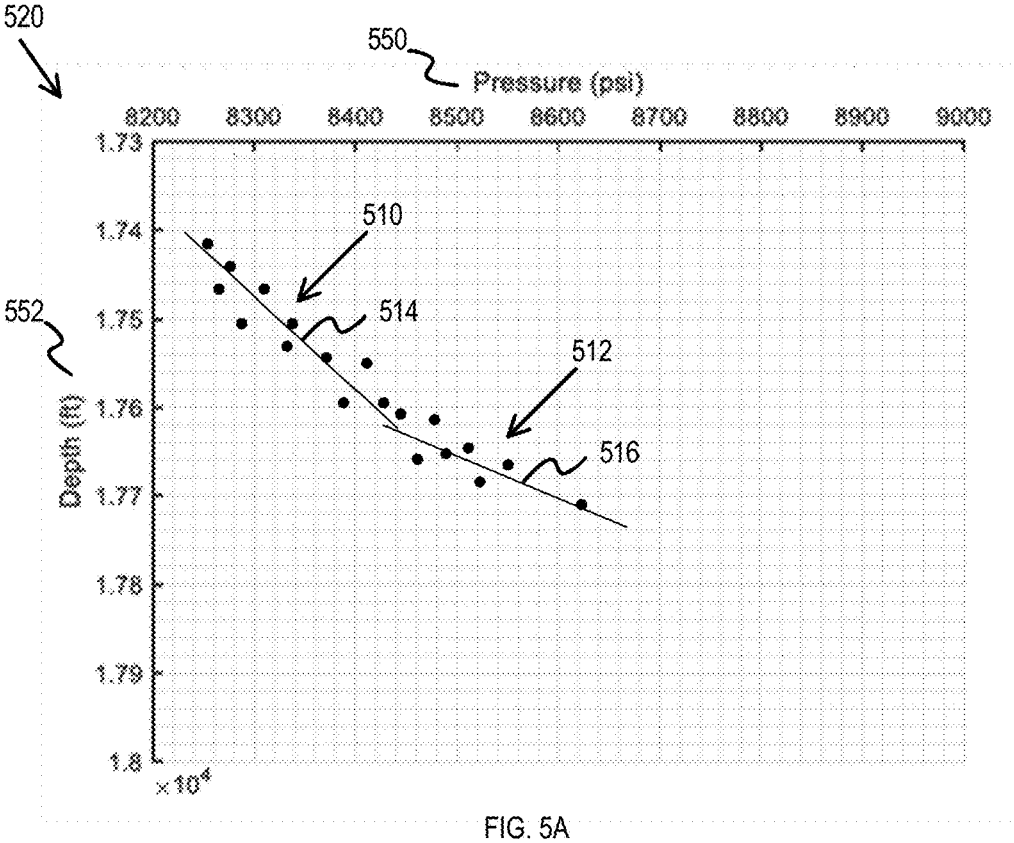
FIG. 5A-5B depict example graphs of partitions of a set of pressure-depth measurement pairs that convey inter-gradient constraints, according to some embodiments.
Figure 5B:
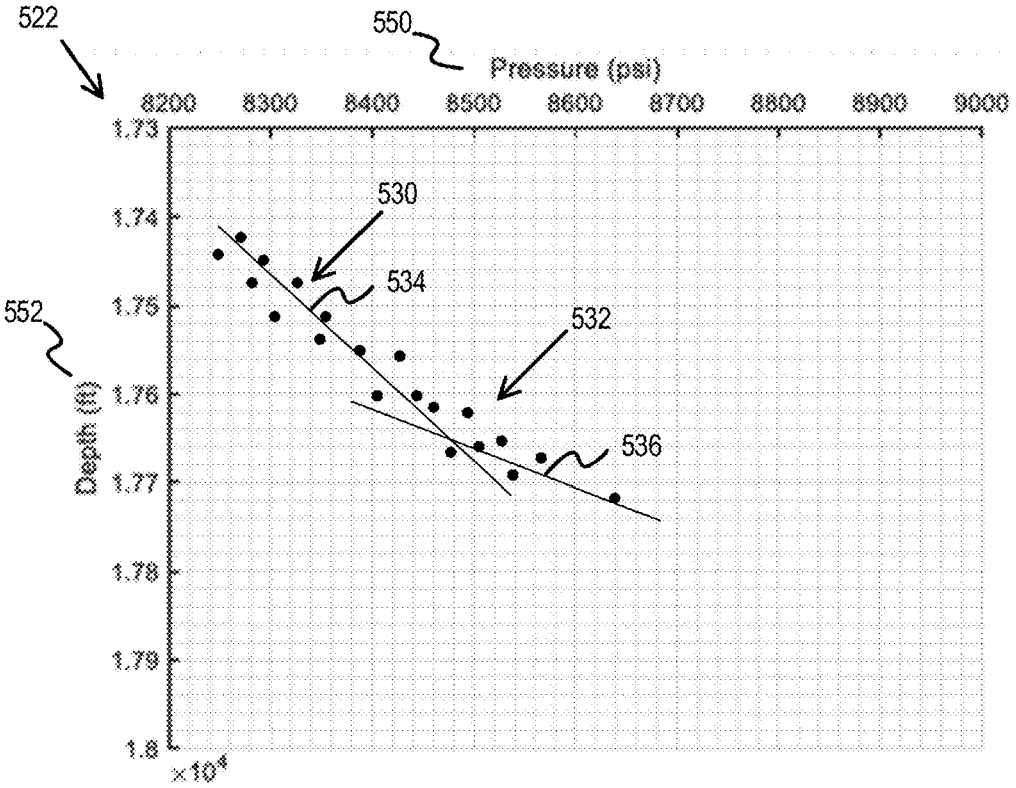

For example, FIG. 5A-5B depict example graphs of partitions of a set of pressure-depth measurement pairs that convey inter-gradient constraints, according to some embodiments. More precisely, FIG. 5A-5B illustrate when two continuous fluids (i.e., in contact) satisfy the inter-gradient constraints and when they do not satisfy the inter-gradient constraints (i.e., the partitioning with respect to the contact point violates the physical constraints of in-contact fluids, dubbed inter-gradient constraints). FIG. 5A depicts a graph 520 that includes an x-axis 550 and a y-axis 552. The x-axis 550 is the pressure that is sampled in the subsurface formation and having units in pounds per square inch (psi). The y-axis 552 is the depth that the sample was obtained and having in units of feet (ft). Measurement points 510 are fit with a linear fit 514 and measurement points 512 are fit with a linear fit 516. As can be seen in FIG. 5A, the fitting satisfies the inter-gradient constraints because reconstructions of measurement points 510 by linear fit 514 all lie in the upper halfspace of the linear fit 516 and conversely reconstructions of measurement points 512 by linear fit 516 all lie in the upper halfspace of the linear fit 514. FIG. depicts a graph 522 that includes that same dataset of pressure-depth measurement pairs as depicted in FIG. 5A, on a similar x-axis 550 and y-axis 552. The dataset of FIG. 5B is partitioned such that measurement points 530 are fit with a linear fit 534 and measurement points 532 are fit with a linear fit 536. As can be seen in FIG. 5B, the fitting violates the inter-gradient constraints because not all reconstructions of measurement points 532 by linear fit 536 lie in the upper halfspace of linear fit 534. Constraints for any two intersecting (i.e., in contact) fluid gradients, represented by Equations 8-10, can be summarized as follows:

$$m_i < m_{i+1} \forall i \tag{8}$$

$$m_i x_j + b_i \geq m_{i+1} x_j + b_{i+1} \forall i, \forall j \in P^i \tag{9}$$

$$m_{i+1} x_j + b_{i+1} \geq m_i x_j + b_i \forall i, \forall j \in P^{i+1} \tag{10}$$

Where i is the fluid index increasing with depth, x is a vector of measured depths, m is a vector of gradient slopes to be solved for, b is a vector of gradient offsets to be solved for, and $P_i$ is a subset in partition P of index i.

In alternative embodiments, increasing-slope constraints for continuous fluids may be augmented by additional continuity constraints such as sufficient slope difference between consecutive gradients over specific slope ranges (e.g., a difference in the slope between at least two consecutive continuous-gradients is greater than a threshold), or slope range exclusivity constraints (e.g., no two consecutive gradients may be simultaneously in any of pre-defined slope intervals).

A constrained robust fit of each fluid depth range in the underlying partitioning may be based on the constraints. The constrained robust fit may be characterized as an iterated sequence of constrained weighted least squares problem. In the first iteration, a standard least squares may be solved subject to the required constraints. Residuals may then be analyzed, and a respective set of weights may be generated based on a weight function, represented below by bisquare (•), that may be inversely proportional to the residuals (see Equations 11-12 below). For example, with reference to FIG. 1, a processor of the computer 190 can perform these operations. The constrained least squares problem may then be iterated based on the set of weights obtained until convergence.

$$\text{bisquare}(r, \text{cutoff}) \triangleq \left(1 - \left(\frac{r}{\text{cutoff}}\right)^2\right)^2 \tag{11}$$

$$\text{cutoff} \triangleq \text{tuning} * \text{median}(\text{abs}(\text{residuals})) \tag{12}$$

Where tuning is a tuning constant, residuals is a set of constrained fit residuals, r is an individual residual, cutoff is a cutoff value used in weight function, and bisquare (•) is a weight function.

Such a constrained robust fit may be adequate for a number of datasets of pressure-depth measurement pairs with the exception of those exhibiting a significant outlier presence particularly where the noise distribution may be right-skewed. If there is a significant outlier presence with right skewness (e.g., with reference to FIG. 4A, outliers 490), then a left-most rule may be incorporated into the constrained robust fit. The incorporation of the left-most rule may be made by a simple adaption of the weight function. For instance, instead of having a symmetrical tuning constant for weighting positive and negative residuals, a separate tuning constant may be used for the positive residuals. To ignore more of the positive residuals, the separate tuning constant may need to be less than that for the negative residuals. In some embodiments, determination of the separate tuning constant may be performed via the specification of a target error (i.e., the tuning constant for the positive residuals may be optimized so as to meet the desired target error). The optimization may be carried out via a root-finding algorithm. First, the weight function (Equation 12) can be reconfigured so as to make a distinction between positive and negative residuals. The reconfigured Equation 12 is represented by Equations 13-16 below.

$$\text{cutoff tuning}^+ \triangleq \text{median}(\text{abs}(\text{residuals})) \tag{13}$$

$$\text{cutoff tuning}^- \triangleq \text{median}(\text{abs}(\text{residuals})) \tag{14}$$

$$w^+ \triangleq (\text{bisquare}(r^+, \text{cutoff}^+) | r^+ \geq 0) \tag{15}$$

$$w^- \triangleq (\text{bisquare}(r^-, \text{cutoff}^-) | r^- < 0) \tag{16}$$

Where $\text{tuning}^+$ is a tuning constant for positive residuals, $\text{tuning}^-$ is a tuning constant for negative residuals, $\text{cutoff}^+$ is a cutoff value for positive residuals, $\text{cutoff}^-$ is a cutoff value for negative residuals, $w^+$ is a weight vector for positive residuals, and $w^-$ is a weight vector for negative residuals.

Some embodiments may prefix $\text{tuning}^-$ to a default value while $\text{tuning}^+$ is optimized so as to satisfy a predefined target error. To help illustrate, Table 2 below depicts an example pseudocode for optimizing $\text{tuning}^+$.

TABLE 2

| Optimizing $\text{tuning}^+$ |
|---|
| 1. Predefine $\text{tuning}^-$ |
| 2. Obtain target_error |
| 3. If error from standard robust fit ≤ target_error |
| 4. Then, RETURN $\text{tuning}^-$ for $\text{tuning}^+$ (symmetrical default) |
| 5. Else |
| 6. $f(\text{tuning}^+) \triangleq E_{w(\text{tuning}^+),P}(m, b)$ |
| 7. $g(\text{tuning}^+) \triangleq f(\text{tuning}^+) - \text{target_error}$ |
| 8. Find the root of g(. ) |
| 9. RETURN above root for $\text{tuning}^+$ (target-constrained negative bias) |
| 10. END |

Where g is evaluates the difference between the achieved error and the target error as a function of the tuning parameter, $\text{tuning}^+$. The root of g(•) (see step 8 of the pseudocode in Table 2) can be determined using different techniques. One example technique for determining the root of g(•) can include the pseudocode depicted in Table 3 below for the Regula Falsi method of root finding as one familiar with the literature would appreciate.

TABLE 3

| Root Finding |
|---|
| Regula Falsi (false position method): |
| solving g(x) = 0 |
| 1. Fix initial $x_0$ and $x_1$ according to iteration maintenance rule below |
| 2. Repeat |
| a. Increment current iteration index, labelled n |
| b. Identify iteration index k as the most recent iteration index such that $g(x_{n-1})$ and $g(x_k)$ have different signs (iteration maintenance) |
| c. Set $x_n = x_{n-1} - g(x_{n-1})\frac{x_{n-1} - x_k}{g(x_{n-1}) - g(x_k)}$ |
| 3. Until $x_n$ stops changing or number of maximum iterations is exhausted |

The subsurface formations in the sampling depth interval may comprise both continuous and discontinuous (i.e., non-fluid-bearing or a barrier) subsurface formations. For instance, with reference to FIG. 1, subsurface formation 176 may be continuous and may be located directly beneath subsurface formation 174 that may be noncontinuous, and the noncontinuous subsurface formation 174 may be located directly beneath subsurface formation 172 which may also be continuous (i.e., a discontinuous configuration).

In some embodiments, discontinuous subsurface formations do not adhere to the same constraints mentioned above. Determination of a fluid gradient of a reservoir fluid of a fluid depth range that follows a discontinuous subsurface formation may be observed as a fluid gradient that is "right-shifted" (i.e., having an offset term that is lower than what it would have been had there not been a discontinuity). As such, both forms of inter-gradient constraints (e.g., the increasing slope inter-gradient constraint and the halfspace-related inter-gradient constraint) may need to be appropriately accommodated when a discontinuity can be recognized.

The hybrid continuous-discontinuous gradient profile problem may be formulated via the incorporation of at least one additional parameter for each fluid gradient. Hence, in addition to the slope and offset terms, each fluid gradient may also be parameterized via a binary shift parameter. The increasing-slope and the halfspace-related inter-gradient constraints may be relaxed when there is a discontinuous subsurface formation between continuous subsurface formations (i.e., subsurface formation 174 and in between subsurface formations 172, 176). Such relaxations may be achieved via solving for the binary shift values wherein a value of 1 indicates a need for constraint relaxation (and thus recognizing a discontinuity) and zero indicating fluid continuity.

Thus, in some embodiments, the constrained robust fit algorithm for determining fluid gradients in a sampling depth range with a discontinuous configuration may begin by first performing a constrained robust fit with the additional shift parameters by relaxing the inter-gradient constraints governing fluids that are in contact. The fitting error may be obtained from such a problem subject to shift corrections. Next, a second problem may be formulated where the same adapted constraints are used. A new constraint can be added on the fitting error to be bounded by the error obtained in the preceding problem, and a new optimization objective of minimizing the number of required fluid gradient shifts. Such an objective may be in line with the minimum description length ("MDL") principle (e.g., simplest explanation or Occam's Razor).

At block 208, a determination is made of whether a required number of partitions of the pressure-depth measurement pairs have been exhausted. For example, the sample depth range can be partitioned again, via a metaheuristic process, to determine different fluid depth ranges in the pressure-depth measurement pairs (204) and the fitting operation can be performed on the new fluid depth ranges (206). Operations described in blocks 204 and 206 may be repeated until approximately all possible fluid depth ranges and associated fluid gradients have been determined. Each of the possible fluid depth ranges and associated fluid gradients may be a solution. FIG. 4A-4K depict different example solutions (as described above). The collection of solutions generated by the partitioning and fitting operations may yield a solution set. In some embodiments, the solution set may comprise one or more solutions. In some instances, there may be duplicate solutions in a solution set with respect to other solutions in the solution set. If all (or a bound thereof) ways of partitioning have not yet been exhausted, then operations return to block 204 to complete generation of solution set. Otherwise, operations proceed to block 210

At block 210, the solution set is pruned to identify optimal solutions. For example, with reference to FIG. 1, a processor of the computer 190 can perform this pruning. Pruning and/or reducing the solution set can include one or more operations. For example, the solution set may be pruned by filtering out duplicate solutions. The solution set may also be filtered based on a given upper bound on the energy function (e.g., a bound on the weighted residual norm). The solution set may also be filtered based on a given upper bound on the energy function that may be identified from an elbow-curve analysis. In some embodiments, the solution set can be pruned to just include only the top k solutions for a predefined number of k solutions. For example, the solution set may be reduced down to 10 solutions if k is set to 10. In some implementations, the solution set can also be pruned by defining a set of solution features and a partial order on the vector space of the feature vectors. The solution set can then be pruned to include all optimum solutions based on the devised ordering relation.

At block 212, the interpretation uncertainty of the solution set is determined. For example, with reference to FIG. 1, a processor of the compute 190 can perform this operation. In some embodiments, a recommendation engine can determine the interpretation uncertainty. The recommendation engine may characterize the uncertainty and guide further measurement sampling based on the characterized uncertainty with the objective of iteratively reducing the interpretation uncertainty of fluid gradient analysis. In some embodiments, the recommendation engine may provide a synthesis of detected outliers based on accepted solutions. The synthesis may provide information on the likely measurement gaps (i.e., distance between pressure-depth measurement pairs) within the sampling depth range. This information may be used as a basis for up-sampling recommendations. In some embodiments, the recommendation may provide a synthesis of fluid gradient uncertainty based on the accepted solutions. The synthesis may be used to define at least one new target pressure-depth measurement pair that maximize an expectation of uncertainty reduction.

At block 214, a determination is made of whether an interpretation uncertainty threshold has been exceeded. For example, with reference to FIG. 1, a processor of the computer 190 can perform this determination. A threshold may identify if there are insufficient data to accurately determine reservoir architecture based on the determined solution set. Value of the threshold can be based on one or more criteria. For example, one such criteria can be the maximum distance of any two consecutive depth measurements within the same gradient. For instance, a threshold may be set at 5 feet, 50 feet, 100 feet, etc. such that if the distance between two consecutive same-gradient depth measurements is greater than the threshold distance then the interpretation uncertainty threshold has been exceeded. Another example criteria for setting the value of the interpretation uncertainty threshold can be the number of solutions of sufficient dissimilarity in the determined solution set. For instance, a solution set may not satisfy this criteria if the number of solutions in the solution set is more than a threshold. For example, if the threshold is 10 solutions, the interpretation uncertainty threshold may be exceeded if the determined solution set includes more than 10 solutions. If the interpretation uncertainty threshold has been exceeded, then operations proceed to block 216. Otherwise, operations proceed to block 220

At block 216, at least one new depth within the sampling depth range is determined, based on the uncertainty, to measure the pressure at the associated depth. For example, with reference to FIG. 1, a processor of the computer 190 can perform this operation. In some embodiments, the syntheses provided by the recommendation engine can be used to determine a new depth to sample the pressure and generate a new pressure-depth measurement pair for the sampling depth range. In some embodiments, more than one depth may be recommended by the recommendation engine.

At block 218, pressure is sampled in the subsurface formation at the at least one new depth to generate at least one new pressure-depth measurement pair. For example, with reference to FIG. 1, a wireline tool 148 can sample the pressure and a processor of the computer 190 can perform these operations. The newly generated pressure-depth measurement pair(s) can be added to the existing dataset. For instance, with reference to FIG. 3, the newly generated pressure-depth measurement pair(s) can be added to the sampling points 350. Operations return to blocks 204 to process the updated dataset. Pressure-depth measurement pairs can then again be partitioned (204) and a fitting operation may be performed on each partition (206) to yield a new solution set of one or more solutions.

These operations can be repeated until the interpretation uncertainty threshold is not exceeded (at block 212). If the interpretation uncertainty threshold is not exceeded, operations of the flowchart 200 continue at block 220.

At block 220, the reservoir architecture is determined based on the solution set. For example, with reference to FIG. 1, a processor of the computer 190 can make this determination. In some embodiments, the reservoir architecture may be determined with a single solution or multiple solutions. In some embodiments, the solution set may be used to determine the fluid gradients of each fluid in the sampling depth range. Furthermore, the fluid gradients may then be used to identify the types of fluid in the sampling depth range. For instance, a fluid gradient may indicate that the reservoir fluid present in the corresponding fluid depth range is oil. In some embodiments, the fluid gradients may further be used to determine the reservoir fluid contact points within the subsurface formation. For instance, the intersection of two fluid gradients may correspond to the contact point of two reservoir fluids associated with the respective fluid gradients. In some embodiments, the fluid compartmentalization of the reservoir structure may be determined based on the fluid gradients, reservoir fluid types, reservoir fluid contact points, and/or fluid barriers (nodes).

Figure 6:
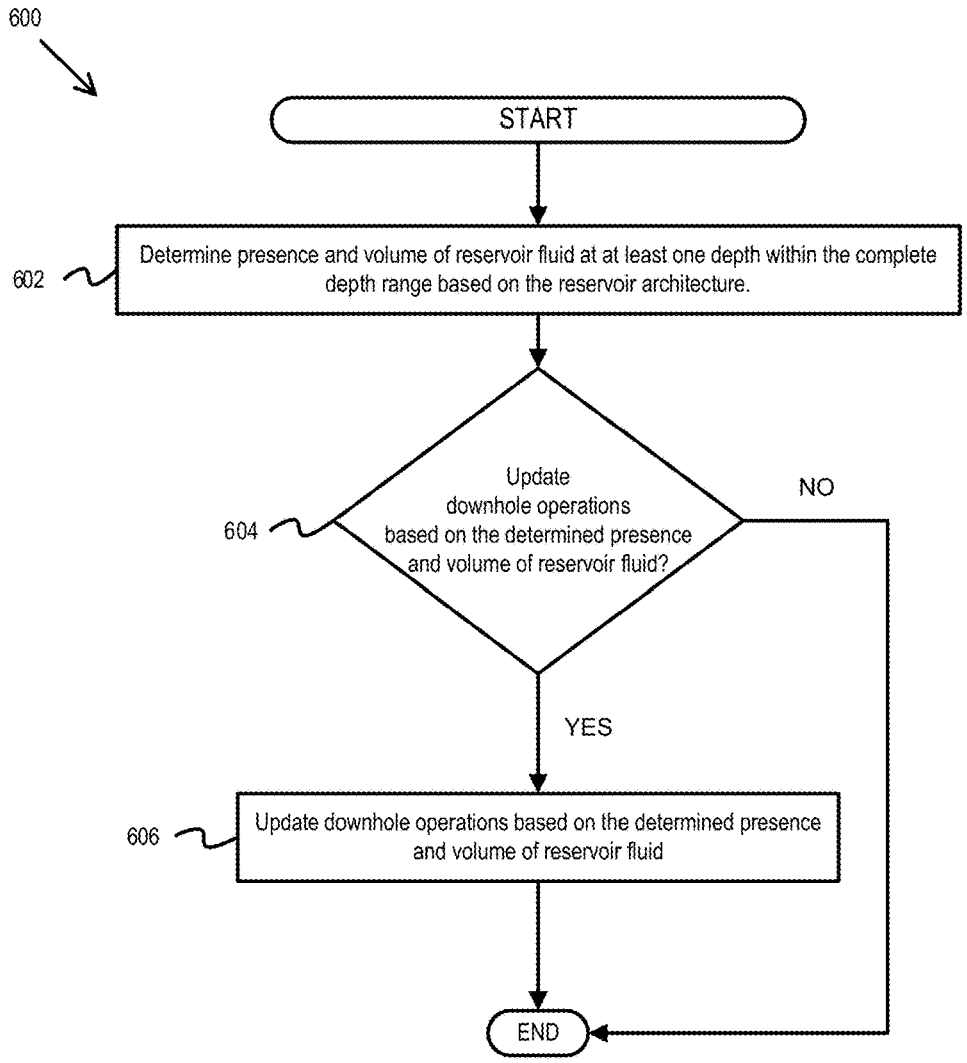
FIG. 6 depicts a flowchart of example operations to adjust downhole operations based on at least one solution of the determined solution set, according to some embodiments.

In some implementations, the determined reservoir architecture can be used to perform and/or update different downhole operations. To illustrate, FIG. 6 depicts a flowchart of example operations to adjust downhole operations based on at least one solution of the determined solution set, according to some embodiments. Operations of flowchart 600 are described in reference to the processor of computer 190 of FIG. 1. Additionally, the operations of flowchart 600 are described in reference to the reservoir architecture determined in flowchart 200. Structure and organization of a program can vary due to platform, programmer/architect preferences, programming language, etc. In addition, names of code units (programs, modules, methods, functions, etc.) can vary for the same reasons and can be arbitrary. Operations of the flowchart 600 start at block 602.

At block 602, the presence and volume of reservoir fluid at at least one depth within the sampling depth range is determined based on the reservoir architecture. For example, with reference to FIG. 1, a processor of the computer 190 can make this determination. For instance, the reservoir fluid types, reservoir fluid contact points, and fluid compartments within a subsurface formation can aid in confirming the presence of hydrocarbons in the subsurface formation, the location of the hydrocarbons in the subsurface formation, and the volume of hydrocarbons withing the subsurface formation. In some embodiments, the reservoir architecture can be used to update reservoir models. For instance, a reservoir model may initially be based on offset well logs, and may be updated with the reservoir architecture to generate a more accurate reservoir model.

At block 604, it is determined if downhole operations need to be updated based on the determined presence and volume of reservoir fluid. For example, with reference to FIG. 1, a processor of the computer 190 can make this determination. Downhole operations may include, but are not limited to, completion of the wellbore, updating drilling operations, perforating, fracking, logging operations, additional sampling of the subsurface formation, etc. For instance, a completion design may have been established based on an initial reservoir model. If the reservoir architecture indicates hydrocarbons are located at a different location in the subsurface formation than what the original reservoir model initially indicated, then the completion design may need to be adjusted to account for the information and maximize production of hydrocarbons from the subsurface formation. If updates to downhole operations are needed, then operations proceed to block 306. Otherwise, operations are terminated.

At block 606, downhole operations are updated based on the determined presence and volume of reservoir fluid. For example, with reference to FIG. 1, a processor of the computer 190 can make this update. For instance, an original completion design comprises of completing (i.e., perforating and hydraulic fracturing) a wellbore from 10,000 feet to 15,000 feet to produce the reservoir fluid from that depth interval of a subsurface formation. If the reservoir architecture indicates that the hydrocarbon-bearing zone in the subsurface formation is actually 9,000 feet to 14,000 feet, the completion design can be adjusted such that the wellbore is sampling in the new depth interval of 9,000 feet to 14,000 feet.

The flowcharts are provided to aid in understanding the illustrations and are not to be used to limit scope of the claims. The flowcharts depict example operations that can vary within the scope of the claims. Additional operations may be performed; fewer operations may be performed; the operations may be performed in parallel; and the operations may be performed in a different order. It will be understood that each block of the flowchart illustrations and/or block diagrams, and combinations of blocks in the flowchart illustrations and/or block diagrams, can be implemented by program code. The program code may be provided to a processor of a general-purpose computer, special purpose computer, or other programmable machine or apparatus.

As will be appreciated, aspects of the disclosure may be embodied as a system, method or program code/instructions stored in one or more machine-readable media. Accordingly, aspects may take the form of hardware, software (including firmware, resident software, micro-code, etc.), or a combination of software and hardware aspects that may all generally be referred to herein as a "circuit," "module" or "system." The functionality presented as individual modules/units in the example illustrations can be organized differently in accordance with any one of platform (operating system and/or hardware), application ecosystem, interfaces, programmer preferences, programming language, administrator preferences, etc.

Any combination of one or more machine-readable medium(s) may be utilized. The machine-readable medium may be a machine-readable signal medium or a machine-readable storage medium. A machine-readable storage medium may be, for example, but not limited to, a system, apparatus, or device, that employs any one of or combination of electronic, magnetic, optical, electromagnetic, infrared, or semiconductor technology to store program code. More specific examples (a non-exhaustive list) of the machine-readable storage medium would include the following: a portable computer diskette, a hard disk, a random-access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing. In the context of this document, a machine-readable storage medium may be any tangible medium that can contain or store a program for use by or in connection with an instruction execution system, apparatus, or device. A machine-readable storage medium is not a machine-readable signal medium.

A machine-readable signal medium may include a propagated data signal with machine readable program code embodied therein, for example, in baseband or as part of a carrier wave. Such a propagated signal may take any of a variety of forms, including, but not limited to, electromagnetic, optical, or any suitable combination thereof. A machine-readable signal medium may be any machine-readable medium that is not a machine-readable storage medium and that can communicate, propagate, or transport a program for use by or in connection with an instruction execution system, apparatus, or device.

Program code embodied on a machine-readable medium may be transmitted using any appropriate medium, including but not limited to wireless, wireline, optical fiber cable, RF, etc., or any suitable combination of the foregoing.

Computer program code for carrying out operations for aspects of the disclosure may be written in any combination of one or more programming languages, including an object oriented programming language such as the Java® programming language, C++ or the like; a dynamic programming language such as Python; a scripting language such as Perl programming language or PowerShell script language; and conventional procedural programming languages, such as the "C" programming language or similar programming languages. The program code may execute entirely on a stand-alone machine, may execute in a distributed manner across multiple machines, and may execute on one machine while providing results and or accepting input on another machine.

The program code/instructions may also be stored in a machine-readable medium that can direct a machine to function in a particular manner, such that the instructions stored in the machine-readable medium produce an article of manufacture including instructions which implement the function/act specified in the flowchart and/or block diagram block or blocks.

Example Drilling System

Figure 7:
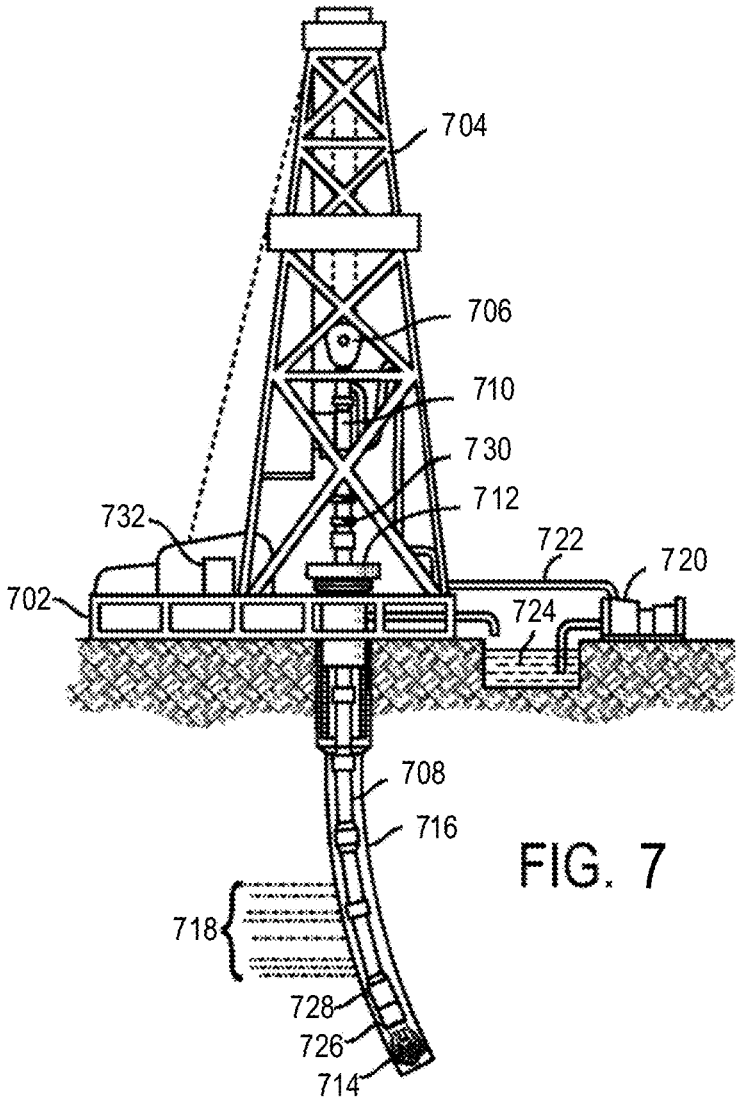
FIG. 7 depicts an example logging while drilling (LWD) system, according to some embodiments.

While described in reference to the example wireline system depicted in FIG. 1, example operations can be performed with any other type of downhole system in different downhole stages. For example, FIG. 7 depicts an example logging while drilling (LWD) system, according to some embodiments. A drilling platform 702 supports a derrick 704 having a traveling block 706 for raising and lowering a drill string 708. A kelly 710 supports the drill string 708 as it is lowered through a rotary table 712. A drill bit 714 is driven by a downhole motor and/or rotation of the drill string 708. As the drill bit 714 rotates, it creates a wellbore 716 that passes through various subsurface formations 718. A pump 720 circulates drilling fluid through a feed pipe 722 to the kelly 710, downhole through the interior of the drill string 708, through orifices in the drill bit 714, back to the surface via the annulus around the drill string 708, and into a retention pit 724. The drilling fluid transports cuttings from the borehole into the retention pit 724 and aids in maintaining the borehole integrity.

A logging tool 726 can be integrated into the bottom-hole assembly near the drill bit 714. As the drill bit 714 extends the wellbore 716 through the formations 718, the bottom-hole assembly can determine pressure measurements at different depths (as described herein). The logging tool 726 may take the form of a drill collar (i.e., a thick-walled tubular that provides weight and rigidity to aid the drilling process). The logging tool 726 can also include one or more navigational packages for determining the position, inclination angle, horizontal angle, and rotational angle of the tool. Such navigational packages can include, for example, accelerometers, magnetometers, and/or sensors.

For purposes of communication, a downhole telemetry sub 728 can be included in the bottom-hole assembly to transfer measurement data to a surface receiver 730 and to receive commands from the surface. Mud pulse telemetry is one common telemetry technique for transferring tool measurements to surface receivers and receiving commands from the surface, but other telemetry techniques can also be used. In some embodiments, the telemetry sub 728 can store logging data for later retrieval at the surface when the logging assembly is recovered.

At the surface, the surface receiver 730 can receive the uplink signal from the downhole telemetry sub 728 and can communicate the signal to a data acquisition module 732. The data acquisition module 732 can include one or more processors, storage mediums, input devices, output devices, software, etc. The data acquisition module 732 can collect, store, and/or process the data received from the logging tool 726 (as described herein).

Although FIGS. 1 and 7 depict specific borehole configurations, it should be understood by those skilled in the art that the present disclosure is equally well suited for use in wellbores having other orientations including vertical wellbores, horizontal wellbores, slanted wellbores, multilateral wellbores, and the like. Also, even though FIGS. 1 and 7 depict an onshore operation, it should be understood by those skilled in the art that the present disclosure is equally well suited for use in offshore operations. Moreover, it should be understood by those skilled in the art that the present disclosure is not limited to the environments depicted in FIGS. 1 and 7, and can also be used, for example, in other well operations such as non-conductive production tubing operations, jointed tubing operations, coiled tubing operations, combinations thereof, and the like.

Example Computer

Figure 8:
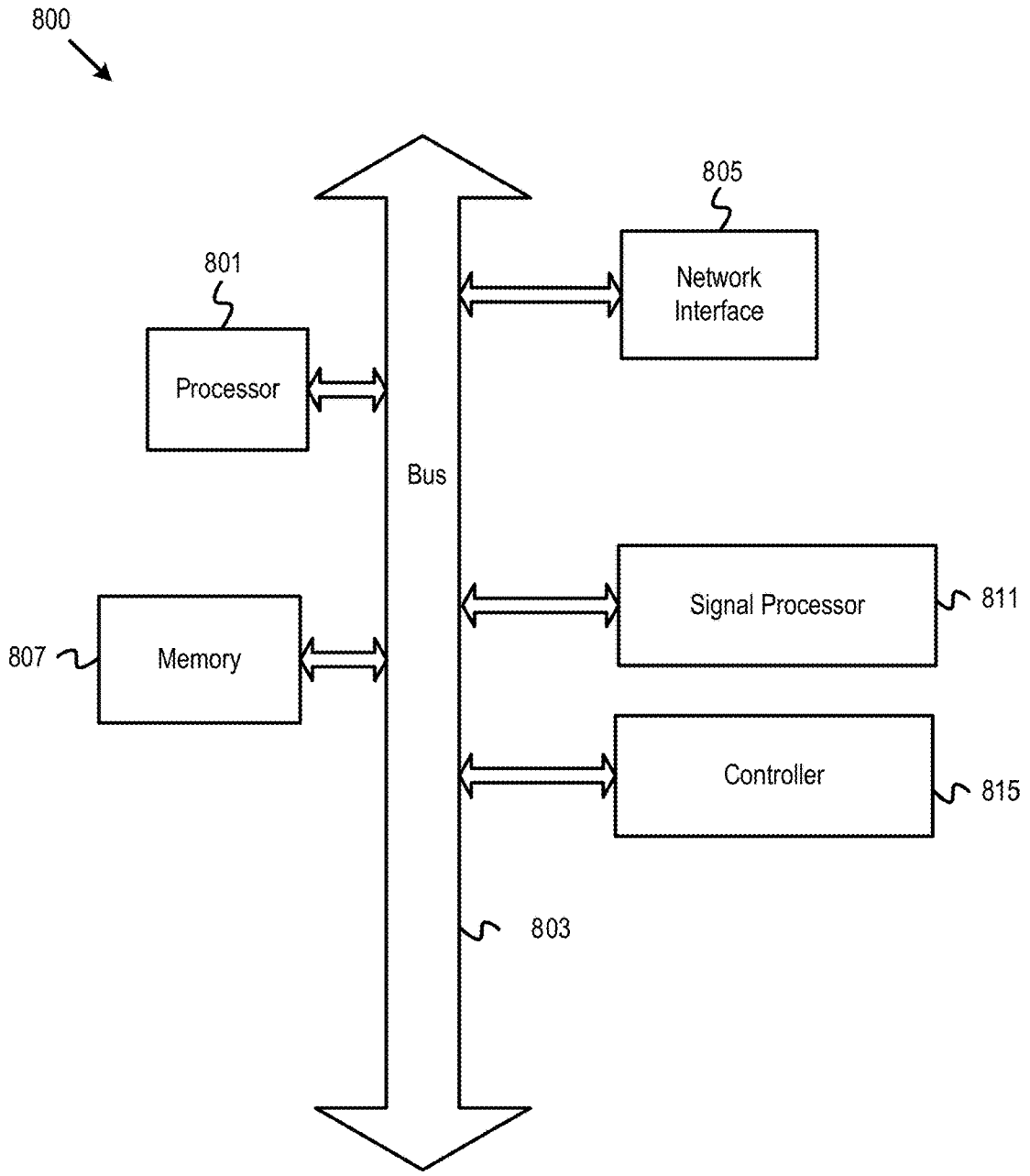
FIG. 8 depicts an example computer, according to some embodiments.

FIG. 8 depicts an example computer, according to some embodiments. FIG. 8 depicts a computer 800 that includes a processor 801 (possibly including multiple processors, multiple cores, multiple nodes, and/or implementing multi-threading, etc.). The computer 800 includes a memory 807. The memory 807 may be system memory or any one or more of the above already described possible realizations of machine-readable media. The computer 800 also includes a bus 803 and a network interface 805.

The computer 800 also includes a signal processor 811 and a controller 815. The signal processor 811 and the controller 815 can perform one or more of the operations described herein. For example, the signal processor 811 can process the pressure/depth pairs to partition the pressure/ depth pairs into fluid depth ranges and determine the fluid gradients of the respective fluid depth ranges. The controller 815 can perform various control operations to a wellbore operation based on the output from the signal processor 811. For example, the controller 815 can modify a completion operation based on the simulations.

Any one of the previously described functionalities may be partially (or entirely) implemented in hardware and/or on the processor 801. For example, the functionality may be implemented with an application specific integrated circuit, in logic implemented in the processor 801, in a co-processor on a peripheral device or card, etc. Further, realizations may include fewer or additional components not illustrated in FIG. 8 (e.g., video cards, audio cards, additional network interfaces, peripheral devices, etc.). The processor 801 and the network interface 805 are coupled to the bus 803. Although illustrated as being coupled to the bus 803, the memory 807 may be coupled to the processor 801.

While the aspects of the disclosure are described with reference to various implementations and exploitations, it will be understood that these aspects are illustrative and that the scope of the claims is not limited to them. In general, techniques for simulating drill bit abrasive wear and damage during the drilling of a wellbore as described herein may be implemented with facilities consistent with any hardware system or hardware systems. Many variations, modifications, additions, and improvements are possible.

Plural instances may be provided for components, operations or structures described herein as a single instance. Finally, boundaries between various components, operations and data stores are somewhat arbitrary, and particular operations are illustrated in the context of specific illustrative configurations. Other allocations of functionality are envisioned and may fall within the scope of the disclosure. In general, structures and functionality presented as separate components in the example configurations may be implemented as a combined structure or component. Similarly, structures and functionality presented as a single component may be implemented as separate components. These and other variations, modifications, additions, and improvements may fall within the scope of the disclosure.

Example Embodiments

Embodiment #1: A method comprising: receiving a measurement of a pressure in a subsurface formation at a number of depths in a wellbore formed in the subsurface formation across a sampling depth range of the subsurface formation to generate a number of pressure-depth measurement pairs; partitioning the sampling depth range into a number of fluid depth ranges, wherein each of the number of fluid depth ranges comprises a range where a type of reservoir fluid is present in the subsurface formation; performing a fitting operation over each of the number of fluid depth ranges to determine a fluid gradient for the type of the reservoir fluid for each of the number of fluid depth ranges; and generating a solution set of one or more solutions based on the fluid gradient of the reservoir fluid for each of the number of fluid depth ranges determined from performing the fitting operation, wherein each solution defines a partitioning of the sampling depth range into the number of fluid depth ranges and the fluid gradient of each of the number of fluid depth ranges.

Embodiment #2: The method of Embodiment #1, wherein partitioning the sampling depth range into the number of fluid depth ranges comprises performing a meta-heuristic method.

Embodiment #3: The method of one or more of Embodiment #1 or #2, further comprising: determining a reservoir architecture across the sampling depth range based on at least one of the fluid gradient for the type of the reservoir fluid for each of the number of fluid depth ranges defined by at least one solution of the solution set and a fluid barrier in the subsurface formation.

Embodiment #4: The method of Embodiment #3, further comprising performing a downhole operation in the wellbore based on the reservoir architecture.

Embodiment #5: The method of one or more of Embodiments #1-4, further comprising: determining an uncertainty of the solution set; and determining, based on the uncertainty, at least one new depth within the sampling depth range to determine the pressure.

Embodiment #6: The method of Embodiment #5, further comprising: receiving a measurement of a pressure in the subsurface formation at the at least one new depth to generate at least one new pressure-depth measurement pair.

Embodiment #7: The method of one or more of Embodiments #1-6, further comprising: pruning the solution set to remove at least one solution from the solution set.

Embodiment #8: The method of one or more of Embodiments #1-7, wherein performing the fitting operation comprises performing a linear fit over each of the number of fluid depth ranges to determine a fluid gradient for the type of the reservoir fluid for each of the number of fluid depth ranges.

Embodiment #9: The method of Embodiment #8, wherein performing the linear fit comprises performing the linear fit having a constraint that constrains an allowable range for a gradient slope of the linear fit based on the type of reservoir fluid.

Embodiment #10: The method of Embodiment #8, wherein performing the linear fit comprises performing the linear fit having at least one constraint that is defined across more than one fluid gradient.

Embodiment #11: The method of Embodiment #10, wherein the at least one constraint includes that a gradient slope of the linear fit is to increase with a depth of the wellbore, that a difference in a slope between at least two consecutive continuous-gradients is greater than a threshold, and that a slope of at least two consecutive gradients is not equal.

Embodiment #12: A system comprising: a sensor to measure a pressure in a subsurface formation at a number of depths in a wellbore formed in the subsurface formation across a sampling depth range of the subsurface formation to generate a number of pressure-depth measurement pairs; a processor; and a computer-readable medium having instructions stored thereon that are executable by the processor to cause the processor to, partition the sampling depth range into a number of fluid depth ranges, wherein each of the number of fluid depth ranges comprises a range where a type of reservoir fluid is present in the subsurface formation; perform a fitting over each of the number of fluid depth ranges to determine a fluid gradient for the type of the reservoir fluid for each of the number of fluid depth ranges; and generate a solution set of one or more solutions based on the fluid gradient of the reservoir fluid for each of the number of fluid depth ranges determined from performing the fitting, wherein each solution defines a partitioning of the sampling depth range into the number of fluid depth ranges and the fluid gradient of each of the number of fluid depth ranges.

Embodiment #13: The system of Embodiment #12, wherein the instructions that are executable by the processor to cause the processor to partition the sampling depth range into the number of fluid depth ranges comprises instructions that are executable by the processor to cause the processor to perform a simulated annealing.

Embodiment #14: The system of one or more of Embodiment #12 or #13, wherein the instructions comprise instructions that are executable by the processor to cause the processor to determine a reservoir architecture across the sampling depth range based on at least one of the fluid gradient for the type of the reservoir fluid for each of the number of fluid depth ranges defined by at least one solution of the solution set and a fluid barrier in the subsurface formation.

Embodiment #15: The system of one or more of Embodiment #12-14, wherein the instructions comprise instructions that are executable by the processor to cause the processor to, determine an uncertainty of the solution set; and determine, based on the uncertainty, at least one new depth within the sampling depth range to determine the pressure, wherein the sensor is to measure a pressure in the subsurface formation at the at least one new depth to generate at least one new pressure-depth measurement pair.

Embodiment #16: The system of one or more of Embodiments #12-15, wherein the instructions that are executable by the processor to cause the processor to perform the fitting comprises instructions that are executable by the processor to cause the processor to perform a linear fit over each of the number of fluid depth ranges to determine a fluid gradient for the type of the reservoir fluid for each of the number of fluid depth ranges.

Embodiment #17: The system of Embodiment #16, wherein the instructions that are executable by the processor to cause the processor to perform the linear fit comprises instructions that are executable by the processor to cause the processor to perform the linear fit having a constraint that comprises at least one of a constraint of an allowable range for a gradient slope of the linear fit based on the type of reservoir fluid, a constraint that is defined across more than one fluid gradient, and a constraint that the gradient slope of the linear fit is to increase with a depth of the wellbore.

Embodiment #18: A non-transitory, computer-readable medium having instructions stored thereon that are executable by a processor to perform operations comprising: receiving a measurement of a pressure in a subsurface formation at a number of depths in a wellbore formed in the subsurface formation across a sampling depth range of the subsurface formation to generate a number of pressure-depth measurement pairs; partitioning the sampling depth range into a number of fluid depth ranges, wherein each of the number of fluid depth ranges comprises a range where a type of reservoir fluid is present in the subsurface formation; performing a fitting operation over each of the number of fluid depth ranges to determine a fluid gradient for the type of the reservoir fluid for each of the number of fluid depth ranges; and generating a solution set of one or more solutions based on the fluid gradient of the reservoir fluid for each of the number of fluid depth ranges determined from performing the fitting operation, wherein each solution defines a partitioning of the sampling depth range into the number of fluid depth ranges and the fluid gradient of each of the number of fluid depth ranges.

Embodiment #19: The non-transitory, computer-readable medium of Embodiment #18, wherein performing the fitting operation comprises performing a linear fit over each of the number of fluid depth ranges to determine a fluid gradient for the type of the reservoir fluid for each of the number of fluid depth ranges.

Embodiment #20: The non-transitory, computer-readable medium of Embodiment #19, wherein performing the linear fit comprises performing the linear fit having a constraint that comprises at least one of, a constraint of an allowable range for a gradient slope of the linear fit based on the type of reservoir fluid; a constraint that is defined across more than one fluid gradient; and a constraint that the gradient slope of the linear fit is to increase with a depth of the wellbore.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" can be infringed with only one of the listed items, multiple of the listed items, and one or more of the items in the list and another item not listed.

What is claimed is:

1. A method comprising:

receiving a measurement of a pressure in a subsurface formation at a number of depths in a wellbore formed in the subsurface formation across a sampling depth range of the subsurface formation to generate a number of pressure-depth measurement pairs;

partitioning the sampling depth range into a number of fluid depth ranges, wherein each of the number of fluid depth ranges comprises a range where a type of reservoir fluid is present in the subsurface formation;

performing a fitting operation over each of the number of fluid depth ranges to determine a fluid gradient for the type of the reservoir fluid for each of the number of fluid depth ranges; and generating a solution set of one or more solutions based on the fluid gradient of the reservoir fluid for each of the number of fluid depth ranges determined from performing the fitting operation, wherein each solution defines a partitioning of the sampling depth range into the number of fluid depth ranges and the fluid gradient of each of the number of fluid depth ranges.

2. The method of claim 1, wherein partitioning the sampling depth range into the number of fluid depth ranges comprises performing a meta-heuristic method.

3. The method of claim 1, further comprising:

determining a reservoir architecture across the sampling depth range based on at least one of the fluid gradient for the type of the reservoir fluid for each of the number of fluid depth ranges defined by at least one solution of the solution set and a fluid barrier in the subsurface formation.

4. The method of claim 3, further comprising performing a downhole operation in the wellbore based on the reservoir architecture.

5. The method of claim 1, further comprising:

determining an uncertainty of the solution set; and determining, based on the uncertainty, at least one new depth within the sampling depth range to determine the pressure.

6. The method of claim 5, further comprising:

receiving a measurement of a pressure in the subsurface formation at the at least one new depth to generate at least one new pressure-depth measurement pair.

7. The method of claim 1, further comprising: pruning the solution set to remove at least one solution from the solution set.

8. The method of claim 1, wherein performing the fitting operation comprises performing a linear fit over each of the number of fluid depth ranges to determine a fluid gradient for the type of the reservoir fluid for each of the number of fluid depth ranges.

9. The method of claim 8, wherein performing the linear fit comprises performing the linear fit having a constraint that constrains an allowable range for a gradient slope of the linear fit based on the type of reservoir fluid.

10. The method of claim 8, wherein performing the linear fit comprises performing the linear fit having at least one constraint that is defined across more than one fluid gradient.

11. The method of claim 10, wherein the at least one constraint includes that a gradient slope of the linear fit is to increase with a depth of the wellbore, that a difference in a slope between at least two consecutive continuous-gradients is greater than a threshold, and that a slope of at least two consecutive gradients is not equal.

12. A system comprising:

a sensor to measure a pressure in a subsurface formation at a number of depths in a wellbore formed in the subsurface formation across a sampling depth range of the subsurface formation to generate a number of pressure-depth measurement pairs;

a processor; and a computer-readable medium having instructions stored thereon that are executable by the processor to cause the processor to, partition the sampling depth range into a number of fluid depth ranges, wherein each of the number of fluid depth ranges comprises a range where a type of reservoir fluid is present in the subsurface formation;

perform a fitting over each of the number of fluid depth ranges to determine a fluid gradient for the type of the reservoir fluid for each of the number of fluid depth ranges; and generate a solution set of one or more solutions based on the fluid gradient of the reservoir fluid for each of the number of fluid depth ranges determined from performing the fitting, wherein each solution defines a partitioning of the sampling depth range into the number of fluid depth ranges and the fluid gradient of each of the number of fluid depth ranges.

13. The system of claim 12, wherein the instructions that are executable by the processor to cause the processor to partition the sampling depth range into the number of fluid depth ranges comprises instructions that are executable by the processor to cause the processor to perform a simulated annealing.

14. The system of claim 12, wherein the instructions comprise instructions that are executable by the processor to cause the processor to determine a reservoir architecture across the sampling depth range based on at least one of the fluid gradient for the type of the reservoir fluid for each of the number of fluid depth ranges defined by at least one solution of the solution set and a fluid barrier in the subsurface formation.

15. The system of claim 12, wherein the instructions comprise instructions that are executable by the processor to cause the processor to, determine an uncertainty of the solution set; and determine, based on the uncertainty, at least one new depth within the sampling depth range to determine the pressure, wherein the sensor is to measure a pressure in the subsurface formation at the at least one new depth to generate at least one new pressure-depth measurement pair.

16. The system of claim 12, wherein the instructions that are executable by the processor to cause the processor to perform the fitting comprises instructions that are executable by the processor to cause the processor to perform a linear fit over each of the number of fluid depth ranges to determine a fluid gradient for the type of the reservoir fluid for each of the number of fluid depth ranges.

17. The system of claim 16, wherein the instructions that are executable by the processor to cause the processor to perform the linear fit comprises instructions that are executable by the processor to cause the processor to perform the linear fit having a constraint that comprises at least one of a constraint of an allowable range for a gradient slope of the linear fit based on the type of reservoir fluid, a constraint that is defined across more than one fluid gradient, and a constraint that the gradient slope of the linear fit is to increase with a depth of the wellbore.

18. A non-transitory, computer-readable medium having instructions stored thereon that are executable by a processor to perform operations comprising:

receiving a measurement of a pressure in a subsurface formation at a number of depths in a wellbore formed in the subsurface formation across a sampling depth range of the subsurface formation to generate a number of pressure-depth measurement pairs;

partitioning the sampling depth range into a number of fluid depth ranges, wherein each of the number of fluid depth ranges comprises a range where a type of reservoir fluid is present in the subsurface formation;

performing a fitting operation over each of the number of fluid depth ranges to determine a fluid gradient for the type of the reservoir fluid for each of the number of fluid depth ranges; and generating a solution set of one or more solutions based on the fluid gradient of the reservoir fluid for each of the number of fluid depth ranges determined from performing the fitting operation, wherein each solution defines a partitioning of the sampling depth range into the number of fluid depth ranges and the fluid gradient of each of the number of fluid depth ranges.

19. The non-transitory, computer-readable medium of claim 18, wherein performing the fitting operation comprises performing a linear fit over each of the number of fluid depth ranges to determine a fluid gradient for the type of the reservoir fluid for each of the number of fluid depth ranges.

20. The non-transitory, computer-readable medium of claim 19, wherein performing the linear fit comprises performing the linear fit having a constraint that comprises at least one of, a constraint of an allowable range for a gradient slope of the linear fit based on the type of reservoir fluid;

a constraint that is defined across more than one fluid gradient; and a constraint that the gradient slope of the linear fit is to increase with a depth of the wellbore.

* * * * *